US012344497B2

(12) United States Patent
Chuah

(10) Patent No.: US 12,344,497 B2
(45) Date of Patent: Jul. 1, 2025

(54) HAND HELD ERGONOMIC ELECTRIC TAPE DISPENSER

(71) Applicant: Khai Gan Chuah, Austin, TX (US)

(72) Inventor: Khai Gan Chuah, Austin, TX (US)

(73) Assignee: Khai Gan Chuah, Austin, TX (US)

( * ) Notice: Subject to any disclaimer, the term of this patent is extended or adjusted under 35 U.S.C. 154(b) by 0 days.

(21) Appl. No.: 18/556,317

(22) PCT Filed: Apr. 19, 2022

(86) PCT No.: PCT/US2022/071789
§ 371 (c)(1),
(2) Date: Oct. 19, 2023

(87) PCT Pub. No.: WO2022/226488
PCT Pub. Date: Oct. 27, 2022

(65) Prior Publication Data

US 2024/0199364 A1 Jun. 20, 2024

Related U.S. Application Data

(63) Continuation of application No. 17/395,437, filed on Aug. 5, 2021, now abandoned.
(Continued)

(51) Int. Cl.
*B65H 35/00* (2006.01)

(52) U.S. Cl.
CPC ..... *B65H 35/002* (2013.01); *B65H 35/0086* (2013.01); *B65H 2301/51532* (2013.01);
(Continued)

(58) Field of Classification Search
CPC ..... B65H 35/002; B65H 35/0033; B65H 35/0086; B65H 2403/92; B65H 2301/5154
See application file for complete search history.

(56) References Cited

U.S. PATENT DOCUMENTS 2,982,292 A 5/1961 Martin
3,650,097 A 3/1972 Nokes
(Continued)

FOREIGN PATENT DOCUMENTS

AU 2019101525 A4 * 1/2020 ..... B65H 35/008
CA 2982292 A1 4/2018
(Continued)

OTHER PUBLICATIONS

International Preliminary Report on Patentability in related International Application No. PCT/US2022/071789, dated Aug. 18, 2023, 17 pages.
(Continued)

*Primary Examiner* — Jennifer S Matthews
(74) *Attorney, Agent, or Firm* — Definitive Patents; Timothy D. Snowden

(57) ABSTRACT

Apparatus and associated methods relate to a handheld power-dispensing tape dispenser having a center of gravity forward of a user's hand. In an illustrative example, a tape dispenser may, for example, include a housing having a handle configured to be held by a human hand. A first roller body may, for example, be rotatably coupled to the housing to rotate about a first axis. A motor may, for example, be disposed in the first roller body. An actuator may, for example, be configured such that, in response to operation of the actuator by a user, the motor induces rotation of the first roller body about the first axis. A second roller body may, for example, be rotatably coupled to the housing and configured to rotate about a second axis substantially parallel to the first axis. Various implementations may advantageously increase stability and/or reduce operator fatigue during taping operations.

27 Claims, 17 Drawing Sheets

Related U.S. Application Data

(60) Provisional application No. 63/177,380, filed on Apr. 20, 2021.

(52) U.S. Cl.
CPC .. *B65H 2301/5154* (2013.01); *B65H 2403/92* (2013.01); *B65H 2551/14* (2013.01); *B65H 2701/37* (2013.01)

(56) References Cited

U.S. PATENT DOCUMENTS

| | | | | |
|---|---|---|---|---|
| 3,730,409 | A | 5/1973 | Ratti | |
| 3,802,309 | A | 4/1974 | Bosland | |
| 4,407,692 | A | 10/1983 | Torbeck | |
| 5,579,669 | A | 12/1996 | Kind et al. | |
| 6,386,415 | B1 | 5/2002 | Tsai | |
| 6,540,002 | B1 * | 4/2003 | Edwards | B65H 35/002 156/577 |
| 7,121,499 | B2 | 10/2006 | Lammers et al. | |
| 7,637,452 | B2 * | 12/2009 | Kanbar | B65H 35/0066 225/10 |
| 8,066,045 | B2 * | 11/2011 | Sleiman | B65C 11/004 156/577 |
| 10,549,941 | B2 * | 2/2020 | Chuah | B65H 35/0026 |
| 11,261,049 | B2 | 3/2022 | Chuah | |
| 2002/0121169 | A1 | 9/2002 | Lemoine | |
| 2005/0077336 | A1 * | 4/2005 | Lammers | B65H 35/0033 225/77 |
| 2007/0125474 | A1 * | 6/2007 | Barker | B65H 37/005 156/577 |
| 2007/0125475 | A1 * | 6/2007 | Cecilio | B65H 37/005 156/577 |
| 2009/0065150 | A1 * | 3/2009 | Tharp | B65C 11/0215 156/384 |
| 2010/0051201 | A1 | 3/2010 | Sleiman | |
| 2015/0336761 | A1 * | 11/2015 | Clayson | B65H 18/28 242/160.4 |
| 2016/0355365 | A1 * | 12/2016 | Werner | B65H 35/0026 |
| 2017/0297853 | A1 * | 10/2017 | Gallegos | B26D 7/00 |
| 2018/0105385 | A1 | 4/2018 | Chuah | |
| 2020/0148496 | A1 | 5/2020 | Chuah | |
| 2020/0187728 | A1 | 6/2020 | Osborne, Jr. | |

FOREIGN PATENT DOCUMENTS

| | | | | |
|---|---|---|---|---|
| CA | 2982292 | C | 5/2023 | |
| JP | 2007297137 | A * | 11/2007 | B65H 35/0066 |
| KR | 102217334 | B1 | 2/2021 | |
| WO | 03099694 | A1 | 12/2003 | |
| WO | 2014060967 | A1 | 4/2014 | |
| WO | WO-2020078526 | A1 * | 4/2020 | |

OTHER PUBLICATIONS

International Search Report and Written Opinion of the International Searching Authority in related International Application No. PCT/US2022/071789, dated Sep. 5, 2022, 13 pages.

Pack-Secure, "Electric Tape Dispenser with Non Stick Rollers—TDA080-P-NS." Retrieved from the internet Apr. 8, 2022 at https://www.pack-secure.com/Electric-Tape-Dispenser-with-Non-Stick-Rollers--Heavy-Duty--TDA080-P-NS_p_7625.html.

* cited by examiner

HAND HELD ERGONOMIC ELECTRIC TAPE DISPENSER

CROSS-REFERENCE TO RELATED APPLICATIONS

This application is a continuation-in-part of and claims the benefit of U.S. application Ser. No. 17/395,437, titled "Electric Hand Held Tape Dispenser," filed by Khai Gan Chuah on Aug. 5, 2021, which application claims the benefit of U.S. Provisional Application Ser. No. 63/177,380, titled "Electric Hand Held Tape Dispenser," filed by Khai Gan Chuah on Apr. 20, 2021. This application also claims the benefit of U.S. Provisional Application Ser. No. 63/177,380, titled "Electric Hand Held Tape Dispenser," filed by Khai Gan Chuah on Apr. 20, 2021. This application incorporates the entire contents of the foregoing application(s) herein by reference.

The subject matter of this application may have common inventorship with and/or may be related to the subject matter of the following: U.S. application Ser. No. 16/702,256, titled "Handheld Electric Tape Dispenser," filed by Khai Gan Chuah on Dec. 3, 2019, and issued as U.S. patent Ser. No. 11/261,049 on Mar. 1, 2022; U.S. application Ser. No. 15/297,046, titled "Handheld Electric Tape Dispenser," filed by Khai Gan Chuah on Oct. 18, 2016, and issued as U.S. patent Ser. No. 10/549,941 on Feb. 4, 2020; U.S. Application Ser. No. 2982292, titled "Hand Held Electric Tape Dispenser," filed by KHAI GAN CHUAH on Oct. 13, 2017; U.S. application Ser. No. 17/395,437, titled "ELECTRIC HAND HELD TAPE DISPENSER," filed by KHAI GAN CHUAH on Aug. 5, 2021; and U.S. Application Ser. No. 63/177,380, titled "ELECTRIC HAND HELD TAPE DISPENSER," filed by KHAI GAN CHUAH on Apr. 20, 2021. This application incorporates the entire contents of the foregoing application(s) herein by reference.

TECHNICAL FIELD

Various implementations relate generally to dispensing of rolled sheet goods.

BACKGROUND

Sheet goods may be dispensed for various purposes. For example, fabric may be dispensed from a roll. Paper may be dispensed for a roll such as, for example, for printing and/or packaging. Fastening sheet goods may, for example, be dispensed from a roll and applied to objects (e.g., packages) for fastening.

As an example, fastening sheet goods may include a backer (e.g., paper, fabric, polymer) and a fastening substance. The fastening substance may, for example, include adhesive. A common form of fastening sheet is tape. Packaging tape may, for example, have a paper and/or polymeric backing layer provided with an adhesive layer. In some implementations, the tape may, for example, be reinforced (e.g., with filaments in one or more directions).

Tape may, for example, be dispensed using a roller. The roller may be used to bring an adhesive surface of the tape in contact with an object to be taped. For example, in shipping operations, items may be packed into cardboard boxes and taped by a manual process of applying the tape. A length of tape may, for example, be severed (e.g., before or after application) from a roll by an operator with scissors, a knife, and/or fixed teeth on a tape dispenser.

SUMMARY

Apparatus and associated methods relate to a handheld power-dispensing tape dispenser having a center of gravity forward of a user's hand. In an illustrative example, a tape dispenser may, for example, include a housing having a handle configured to be held by a human hand. A first roller body may, for example, be rotatably coupled to the housing to rotate about a first axis. A motor may, for example, be disposed in the first roller body. An actuator may, for example, be configured such that, in response to operation of the actuator by a user, the motor induces rotation of the first roller body about the first axis. A second roller body may, for example, be rotatably coupled to the housing and configured to rotate about a second axis substantially parallel to the first axis. Various implementations may advantageously increase stability and/or reduce operator fatigue during taping operations.

Various implementations may achieve one or more advantages. For example, some implementations may advantageously increase the stability and efficiency of a tape dispenser ergonomically during the taping process. In some implementations, power train components (e.g., motor, gearing) may, for example, advantageously be placed forward of a handle. Accordingly, various implementations may advantageously position a center of gravity of a tape dispenser toward a front end of the tape dispenser. In some example implementations, the center of gravity may, for example, be substantially positioned at a location of a dispensing roller (e.g., the first roller body). For example, in some implementations, a majority of a weight of the tape dispenser may be configured to fall on (e.g., be supported by) a target object (e.g., a cardboard box) during a taping operation.

Accordingly, various implementations may, for example, advantageously reduce operator fatigue, such as by transferring weight of the tape dispenser to the target object for support and so reducing force and/or moment applied to the user's wrist.

Various implementations may, for example, advantageously provide increase pressure applied to the target object by the dispensing roller. Such implementations may, for example, advantageously increase force of friction between the dispensing roller and the tape. Some implementations may, for example, advantageously increase force of friction between the dispensing roller, the tape, and/or the target object. Some implementations may, for example, advantageously generate an increased uniformity of pressure distribution on the tape by the dispensing roller.

Various such implementations may, by way of example and not limitation, advantageously increase adherence of the tape to the target object. Some implementations may, by way of example and not limitation, advantageously simultaneously guide and pull the tape smoothly, reducing effort of the operator during a taping process. For example, some implementations may advantageously reduce or eliminate slippage of the tape relative to the target and/or the dispensing roller (e.g., due to inadequate friction and/or application pressure).

Some implementations may implement direct drive of the dispensing roller by the motor (e.g., by having the motor disposed in the dispensing roller). Such implementations may, by way of example and not limitation, advantageously reduce or eliminate sway (e.g., left to right sway) caused by indirect drive (e.g., a motor being disposed away from the dispensing roller) and/or weight distribution away from the dispensing roller. Various such implementations may, for example, advantageously reduce risk of wrist injury of an operator (e.g., during prolonged usage).

In various implementations, heat energy generated by the motor may, for example, advantageously be transferred to the dispensing roller. For example, the heated dispensing roller may advantageously increase adhesion between tape being dispensed and the target object being taped.

Some implementations may advantageously operate a powered cutter to cut the tape at a desired length. In some implementations, by way of example and not limitation, the powered cutter may advantageously be operated by a same motor as drives the dispensing roller. Such implementations may, for example, advantageously reduce production cost and/or size of the tape dispenser.

The details of various implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE IMPLEMENTATIONS

To aid understanding, this document is organized as follows. First, to help introduce discussion of various implementations, a frontal center of gravity tape dispenser system is introduced with reference to FIGS. 1A-2. Second, that introduction leads into a description with reference to FIGS. 3-9 of some exemplary implementations of power-dispensing tape dispensers and tape dispenser components. Third, with reference to FIGS. 10-14, assistive cutter tape dispensers, and components thereof, are described. Fourth, with reference to FIG. 15, the discussion turns to an exemplary architecture of a powered tape dispenser. Fifth, and with reference to FIG. 16, this document describes exemplary methods useful for controlling powered tape dispensers. Finally, the document discusses further implementations, exemplary applications and aspects relating to powered tape dispensers.

Figure 1A:
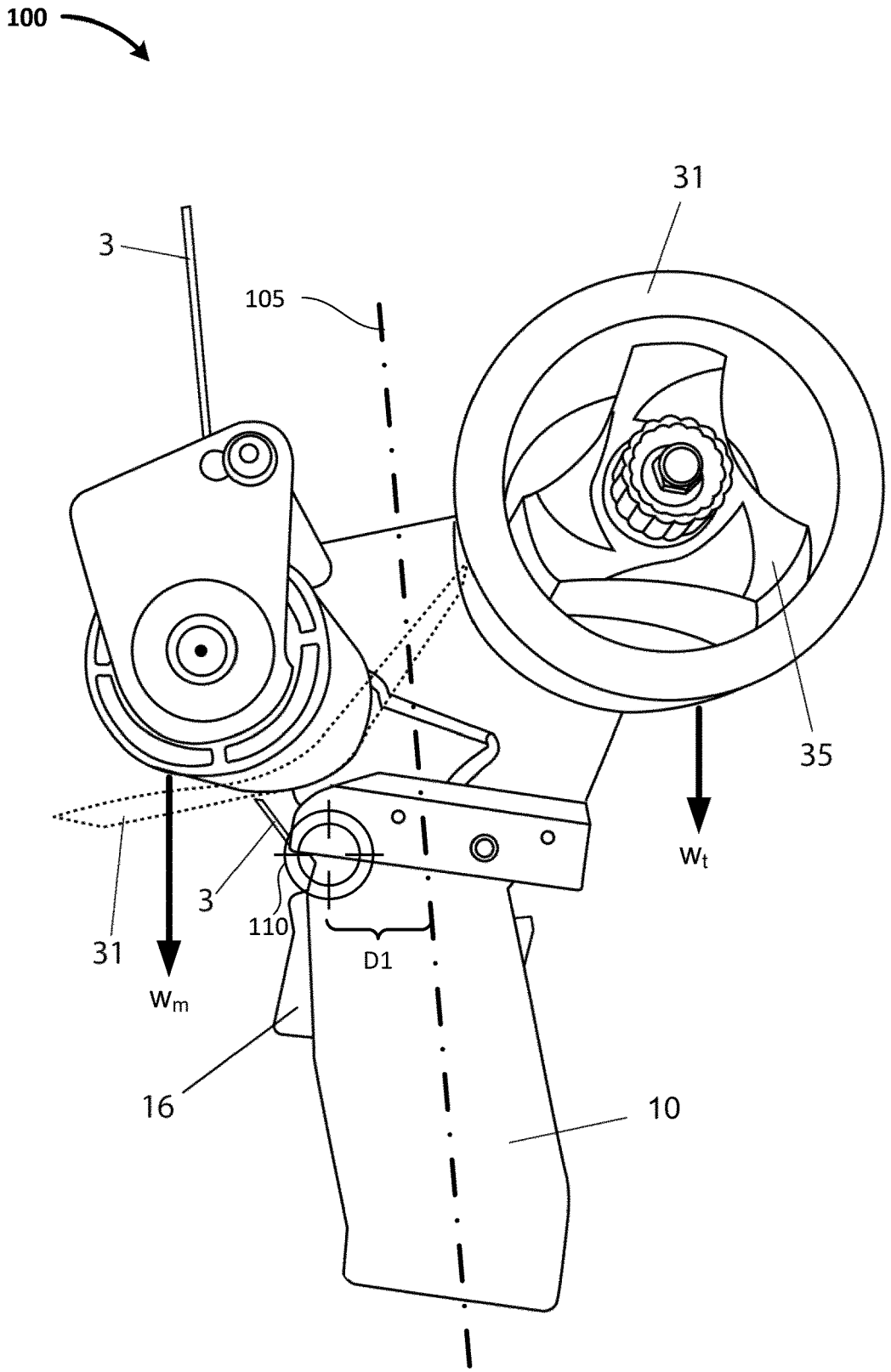
FIG. 1A depicts an exemplary power-dispensing tape dispenser in an illustrative use-case scenario, the tape dispenser being configured with a center of gravity forward of the handle.
Figure 1B:
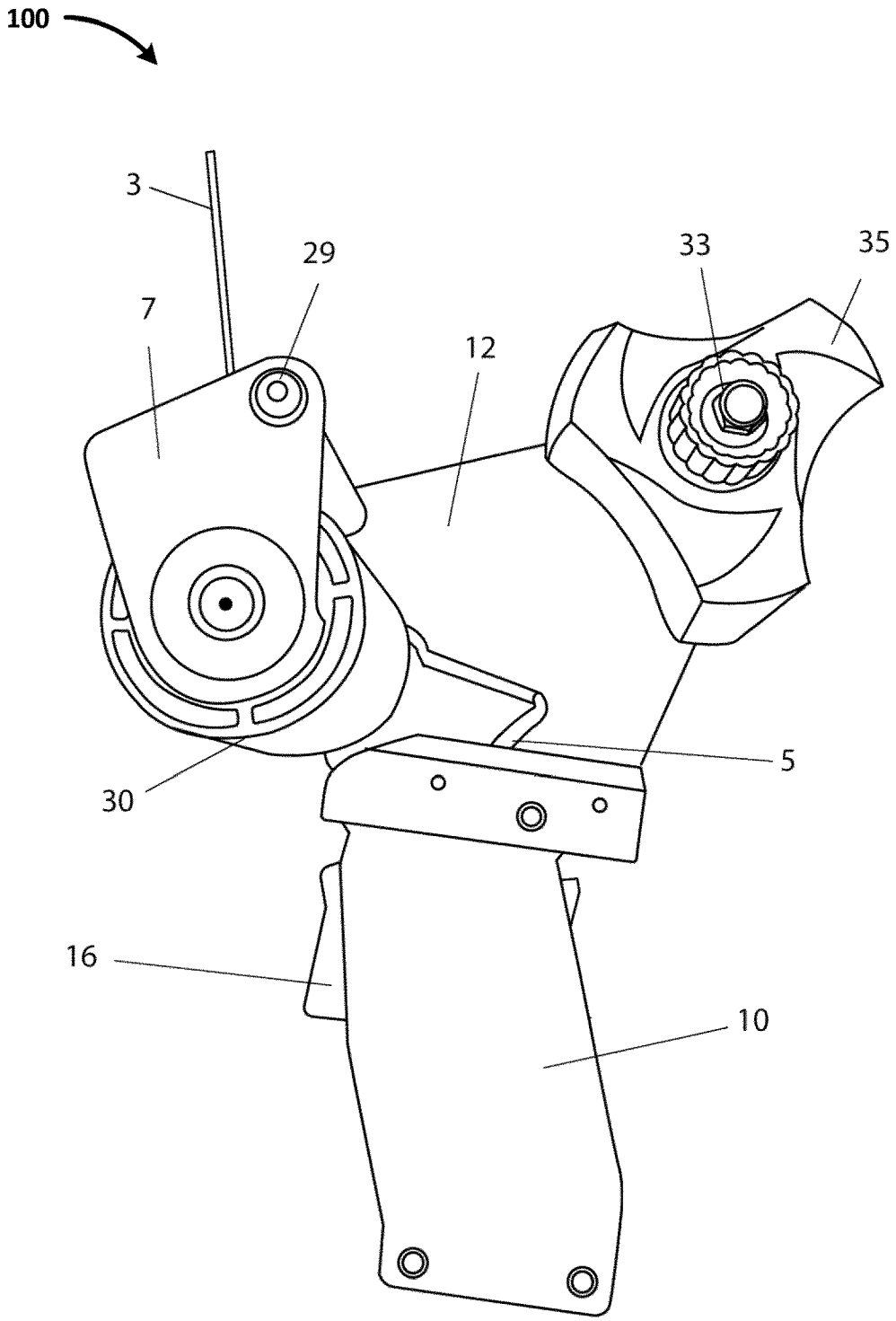
FIG. 1B depicts the exemplary tape dispenser of FIG. 1A.

FIG. 1A depicts an exemplary power-dispensing tape dispenser in an illustrative use-case scenario, the tape dispenser being configured with a center of gravity forward of the handle. FIG. 1B depicts the exemplary tape dispenser of FIG. 1A. A hand-held tape dispenser 100 includes housing. As depicted, the housing includes a handle 10 and a frame 12 mounted into and above the handle 10. In the depicted example, the handle 10 is of a shaft shape, configured for gripping by a human hand. The handle 10, as depicted, extends substantially along a longitudinal axis 105.

Figure 2:
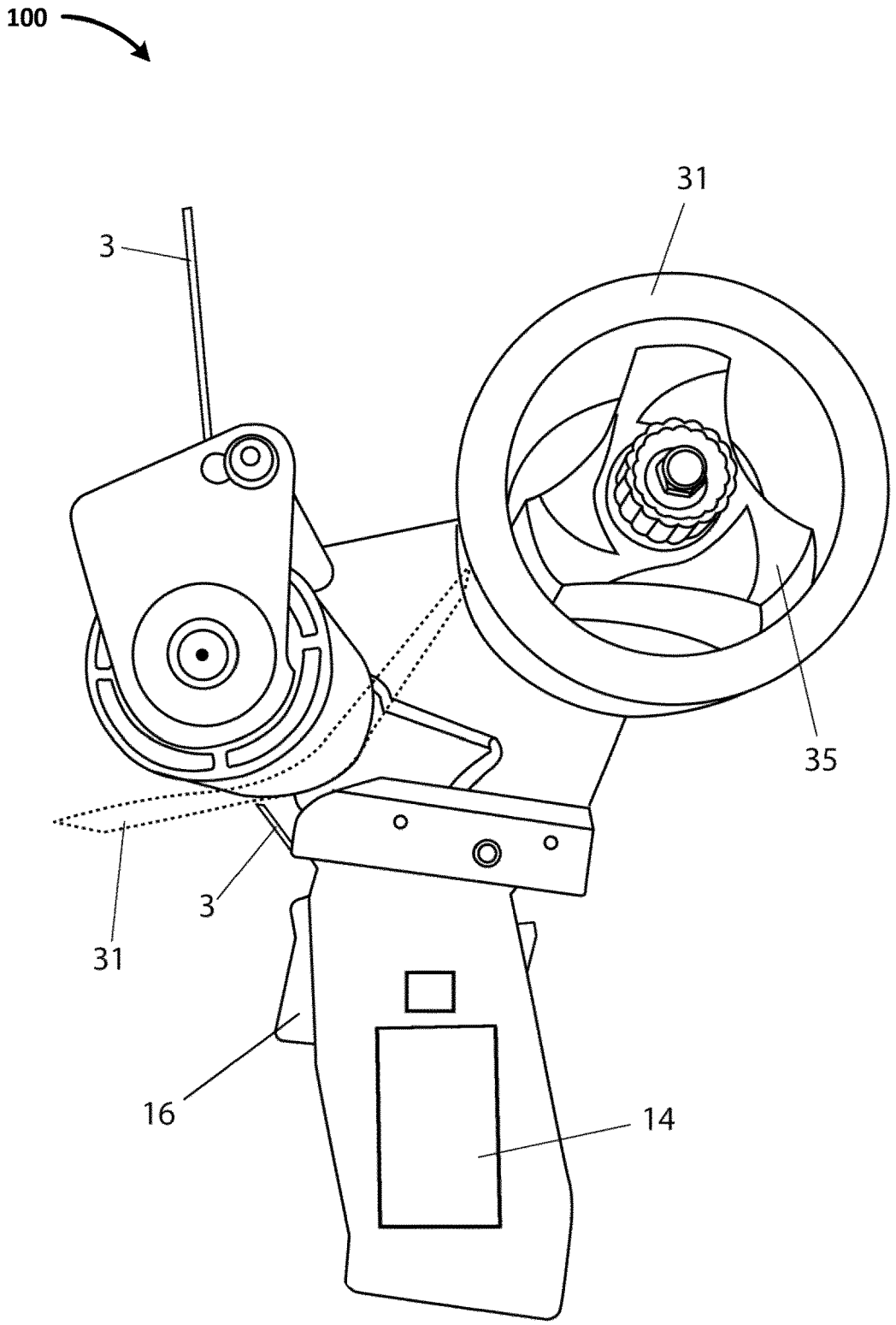
FIG. 2 depicts the exemplary tape dispenser of FIG. 1A in an illustrative use-case scenario (e.g., dispensing tape), and having at least a portion of the housing corresponding to the handle removed for visibility.

FIG. 2 depicts the exemplary tape dispenser of FIG. 1A in an illustrative use-case scenario (e.g., dispensing tape), and having at least a portion of the housing corresponding to the handle removed for visibility. In some implementations, such as shown in FIG. 2, the handle 10 is configured to house a battery 14. As depicted, in some implementations the handle 10 may be configured to house, for example, an actuator (e.g., push button 16). In various implementations, the handle 10 may, by way of example and not limitation, house electronic circuit boards, switches, electric motors, and/or gear components. Such implementations may, for example, advantageously provide an efficient usage of space and/or control of a center of gravity of the hand-held tape dispenser 100.

In the depicted example as shown at least in FIGS. 1A-1B, the main structure of the frame 12 includes a main roller 30. As depicted, a secondary roller (e.g., an adapter 35) is included for mounting a tape 31. The adapter 35 may, for example, be selectively replaceable and/or omitted depending on a configuration of sheet goods to be dispensed by the hand-held tape dispenser 100.

In some implementations, a motor (not shown) and/or drive components (e.g., gearing, belts) (not shown) may be disposed within the main roller 30. The motor may, for example, be an electric motor. The motor may, for example, be configured drive the main roller 30 of the tape. The motor may, for example, be configured to drive rotation of the main roller 30 at a desired speed. The speed may, by way of example and not limitation, be controlled by an optional speed controller (e.g., a speed controller circuit board, not shown).

As depicted, the hand-held tape dispenser 100 is configured such that a center of gravity 110 of the hand-held tape dispenser 100, when the hand-held tape dispenser 100 is in an upright position is a distance DI (e.g., a minimum distance) forward (e.g., towards the main roller 30) of the longitudinal axis 105. The main roller 30 may be configured with a force of gravity ($w_m$) greater than a force of gravity ($w_t$) of the adapter 35 when loaded with a target amount of sheet goods (e.g., the tape 31). For example, the $w_m$ may be at least partially due to the motor and/or the gearing.

Such implementations may, by way of example and not limitation, advantageously transfer weight from a hand of an operator to a target object during a taping operation. Accordingly, operator fatigue may, for example, advantageously be reduced. The main roller 30 may, for example, advantageously apply at least a portion of the $w_m$ to the target object and/or the tape 31 being dispensed by the main roller 30. Accordingly, a pressure distribution and/or force of friction applied to the tape 31 being dispensed and/or the target object may be advantageously increased. For example, the increased force of friction may advantageously reduce slippage of the tape 31 on the main roller 30. For example, the increased force applied may advantageously reduce slippage of the tape 31 relative to the target object during a taping operation. The greater force of $w_m$ may advantageously reduce movement effected by a moment (e.g., torque) due to the $w_t$ inducing side-to-side the sway of the hand-held tape dispenser 100 during taping (e.g., by having greater weight holding the tape directly against the target object). Accordingly, more even tape application and/or enhanced adhesion may be advantageously achieved.

In the depicted example, the adapter 35 is mounted on a shaft 33 and rotates about the shaft 33 while supporting the roll of tape 31 thereon. In various implementations, the frame 12 may, by way of example and not limitation, be of various designs, sizes, and/or shapes. The handle 10 may be disposed in various places relative to the tape dispenser 100. For example, the handle 10 may be implemented in various designs, sizes, orientations, and/or shapes suitable for a user to support and/or control dispensing of tape using the hand-held tape dispenser 100.

In some implementations, a cutter (not shown) may be included. Circuit boards (not shown) may be included in some implementations (e.g., in the handle 10).

The main roller 30 may, for example, be configured to steer rollout of the tape 31. In the depicted example, the hand-held tape dispenser 100 includes a tape guide 3. The tape guide 3 may, for example, support and/or guide the tape as it is rolled out (dispensed) by the main roller 30. The main roller 30 may, for example, press the tape 31 on to a surface of a target object as it is dispensing. In some implementations, by way of example and not limitation, the main roller 30 may include a hollow cylinder drum with at least one open end.

Figure 3:
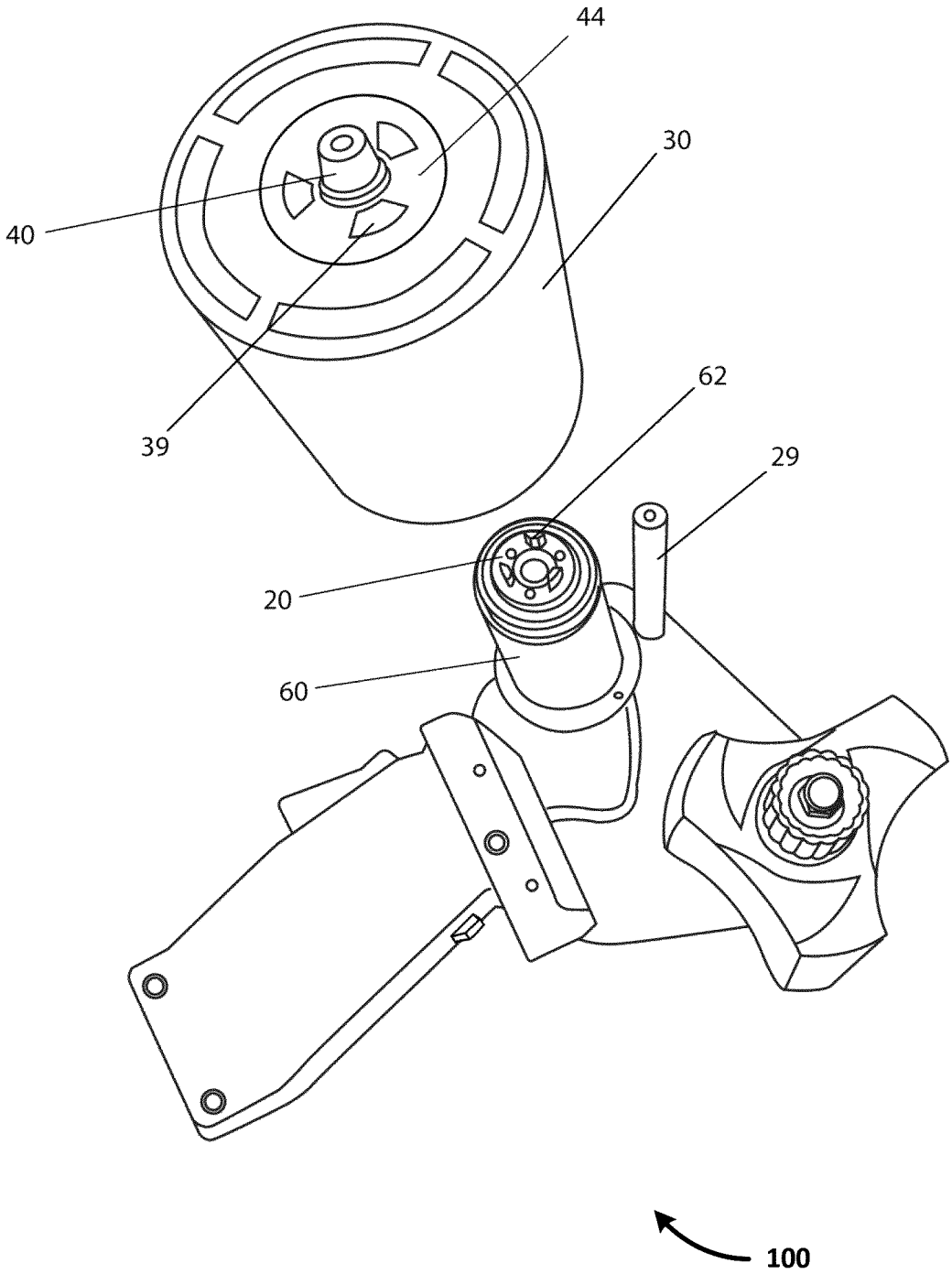
FIG. 3 depicts an exploded view of the exemplary tape dispenser of FIG. 1A, illustrating a main (dispensing) roller, a rotating cap, and a roller base.

FIG. 3 depicts an exploded view of the exemplary tape dispenser of FIG. 1A, illustrating a main (dispensing) roller, a rotating cap, and a roller base. In the depicted example (as shown at least with reference to FIG. 1B, one end of the main roller 30 is connected to roller plate 7. The roller plate 7, as depicted, further connects to the frame 12 via an axle 29. A roller base 60 (as disclosed at least with reference to FIG. 3) is encased by the main roller 30, in this exemplary implementation. The roller base 60 may, for example, be configured as a hollow cylinder drum which holds a gear set 19 in position (e.g., as disclosed at least with reference to FIG. 6).

A temperature of a surrounding environment may be at least one of the factors affecting the taping process. A higher ambient temperature may, for example, achieve better adhesion on a target object than if a taping process is performed at lower temperatures. A higher temperature may, for example, speed up an adhesive reaction when the main roller 30 is in contact with the tape 31, such as during cold weather (e.g., less than 50° F., less than 40° F.). For example, in temperatures less than 32° F., heated application may be important to achieving successful adhesion of at least some tapes to at least some target objects (e.g., packing tape to cardboard boxes).

In some implementations, the roller base 60 may be at least partially made of thermally conductive material (e.g., metal). Accordingly, the roller base 60 may advantageously conduct heat generated by a motor 18 (as disclosed at least with reference to FIG. 6) to the body of the main roller 30. In some implementations, for example, a conductive component (e.g., thermal paste, metallic lining) may be included between the roller base 60 and the main roller 30. The conductive component may, for example, advantageously (further) facilitate heat transference from the roller base 60 to the main roller 30.

In some implementations, a heating element may be provided and thermally coupled to the main roller 30. For example, the heating element (not shown) may be powered by the electric motor 18 and/or the battery 14 (such as disclosed at least with reference to FIG. 2). The heating element may, for example, be thermally coupled to the main roller 30 and/or the roller base 60. Accordingly, the heating element may advantageously provide auxiliary heat to the main roller 30.

In some implementations, by way of example and not limitation, the heating element(s) may be selectively operated (e.g., by a control circuit) to maintain a desired temperature range (e.g., of the main roller 30). For example, at least one temperature sensor may, in some implementations, be configured to monitor a temperature of the main roller 30 and/or the roller base 60. The controller may operate the heating element in response to signal(s) received from the temperature sensor(s).

Figure 4:
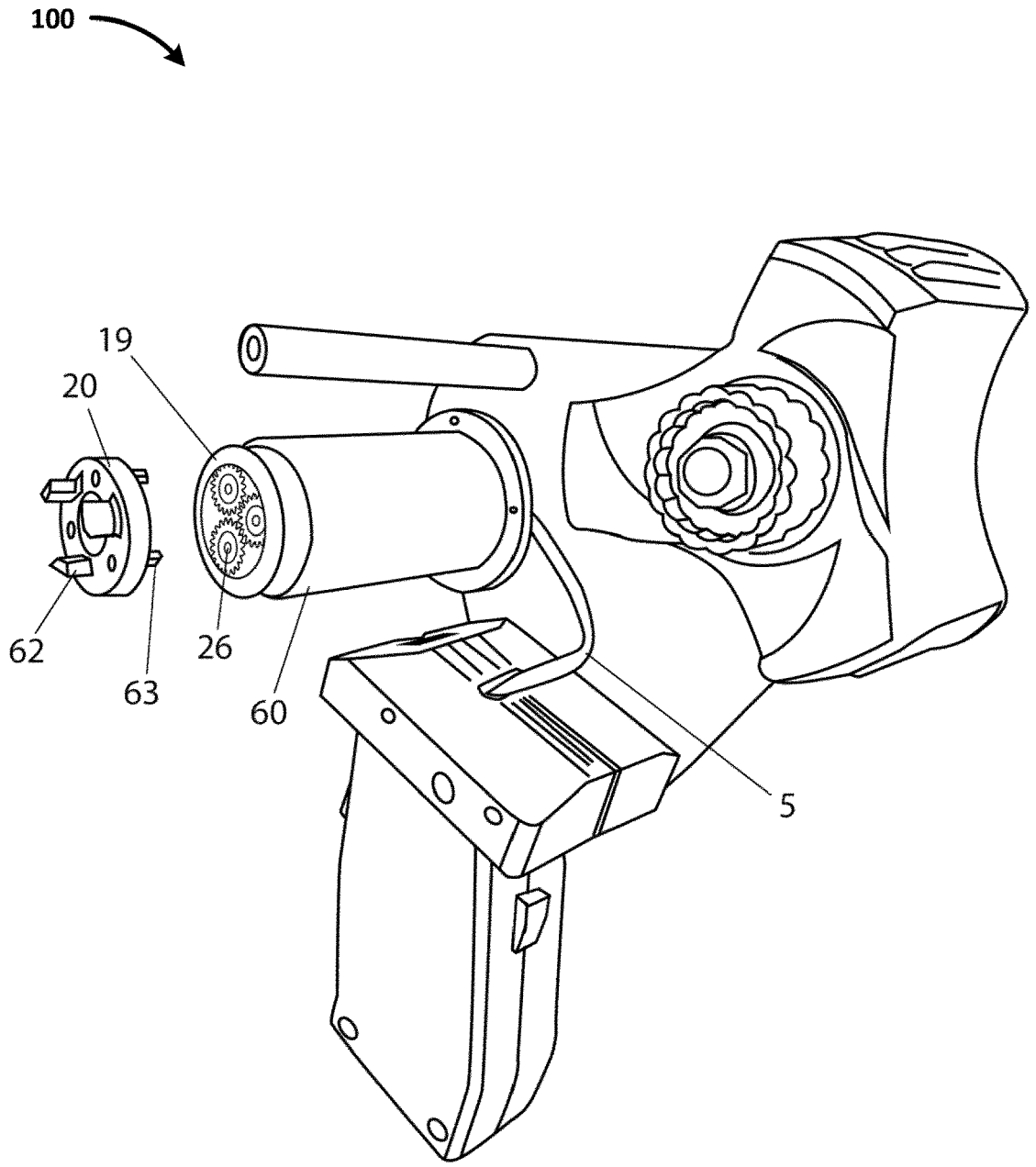
FIG. 4 depicts an exploded view of the exemplary tape dispenser of FIG. 1A, illustrating the rotating cap, a gear component, and the roller base.

FIG. 4 depicts an exploded view of the exemplary tape dispenser of FIG. 1A, illustrating the rotating cap, a gear component, and the roller base. In the depicted example, the drive module includes a gear set 19, a rotating cap 20, and the electric motor 18. In the depicted example, the rotating cap 20 is a circular disc including lower tab(s) 63 and upper tab(s) 62. The upper tab(s) 62 are configured to engage with hole(s) 39 of a wheel hub 44 (disclosed at least with reference to FIG. 3) and rotate the main roller 30. The lower tab(s) 63 are configured to engage eyelets 26 (e.g., apertures, blind holes, engagement features) of the gear set 19. In some implementations, the rotating cap 20 may be of various sizes and/or shapes while achieving the disclosed function(s).

Figure 5:
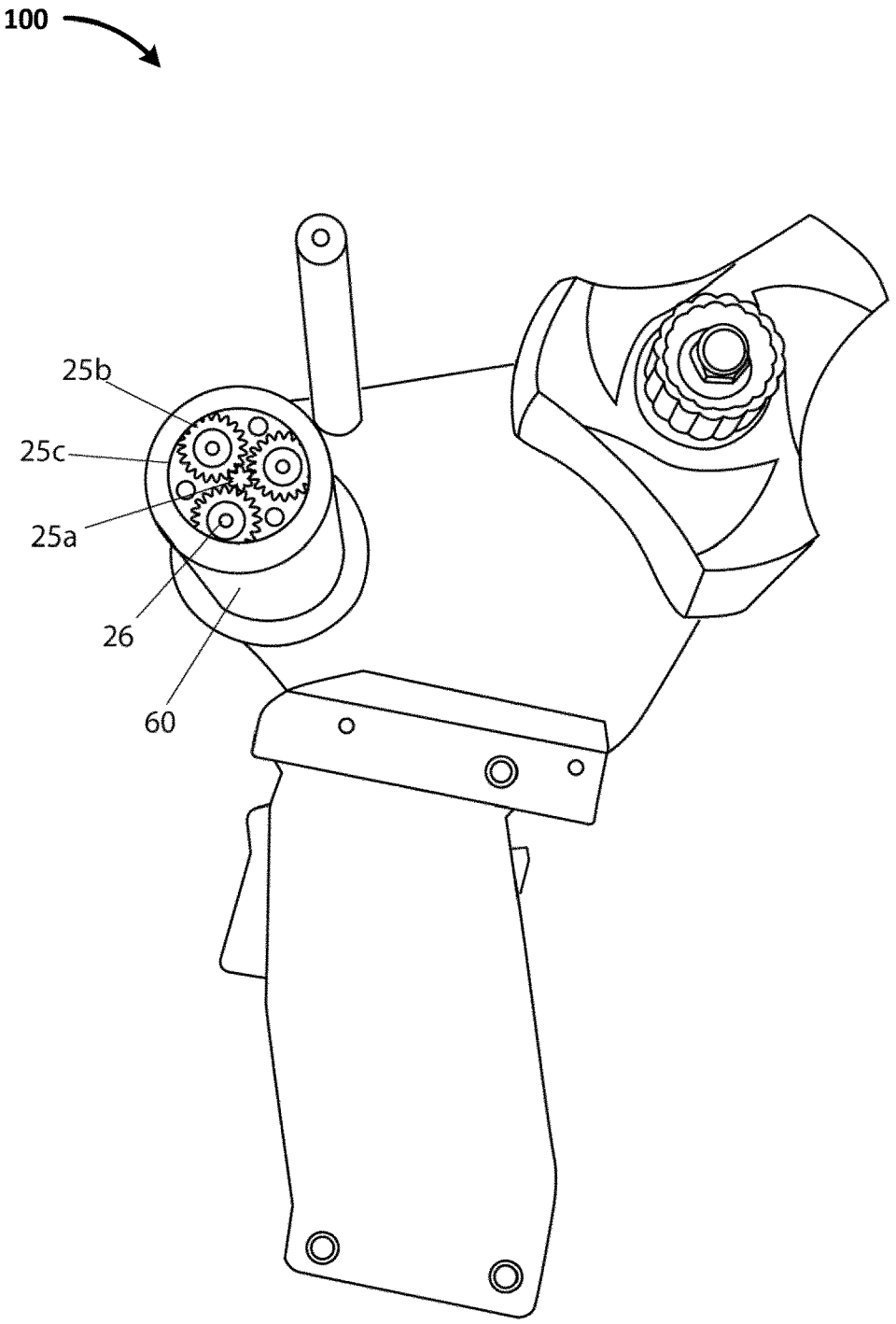
FIG. 5 depicts an exemplary view of the exemplary tape dispenser of FIG. 1A, having at least a portion of the main roller removed to illustrate a portion of the gear component(s) and the roller base.
Figure 6:
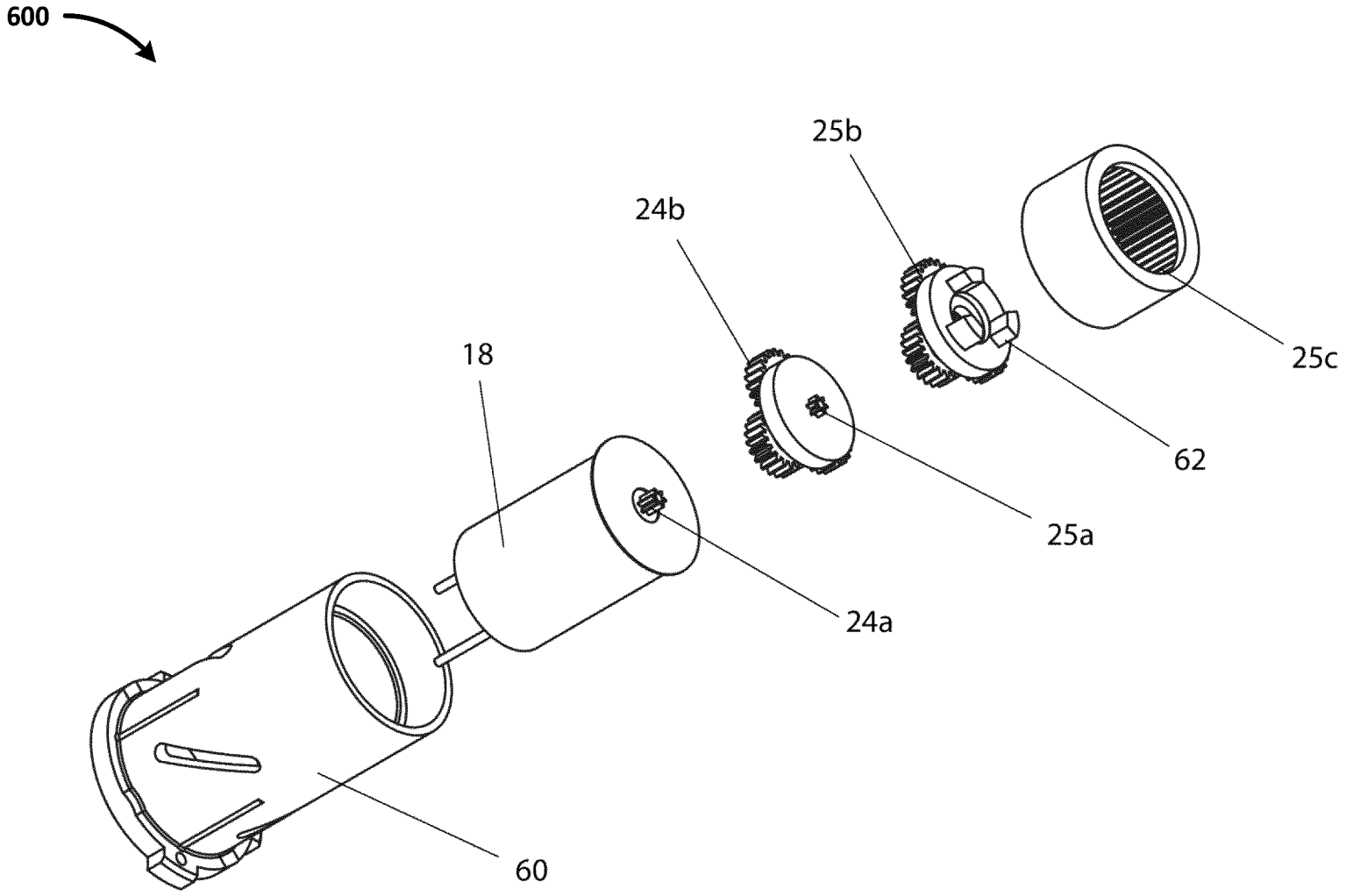
FIG. 6 depicts an exemplary exploded view of a portion of the main roller assembly, the view illustrating the roller base, an electric motor disposed in the roller base, a gear set disposed in the roller base, and the rotating cap.
Figure 7:
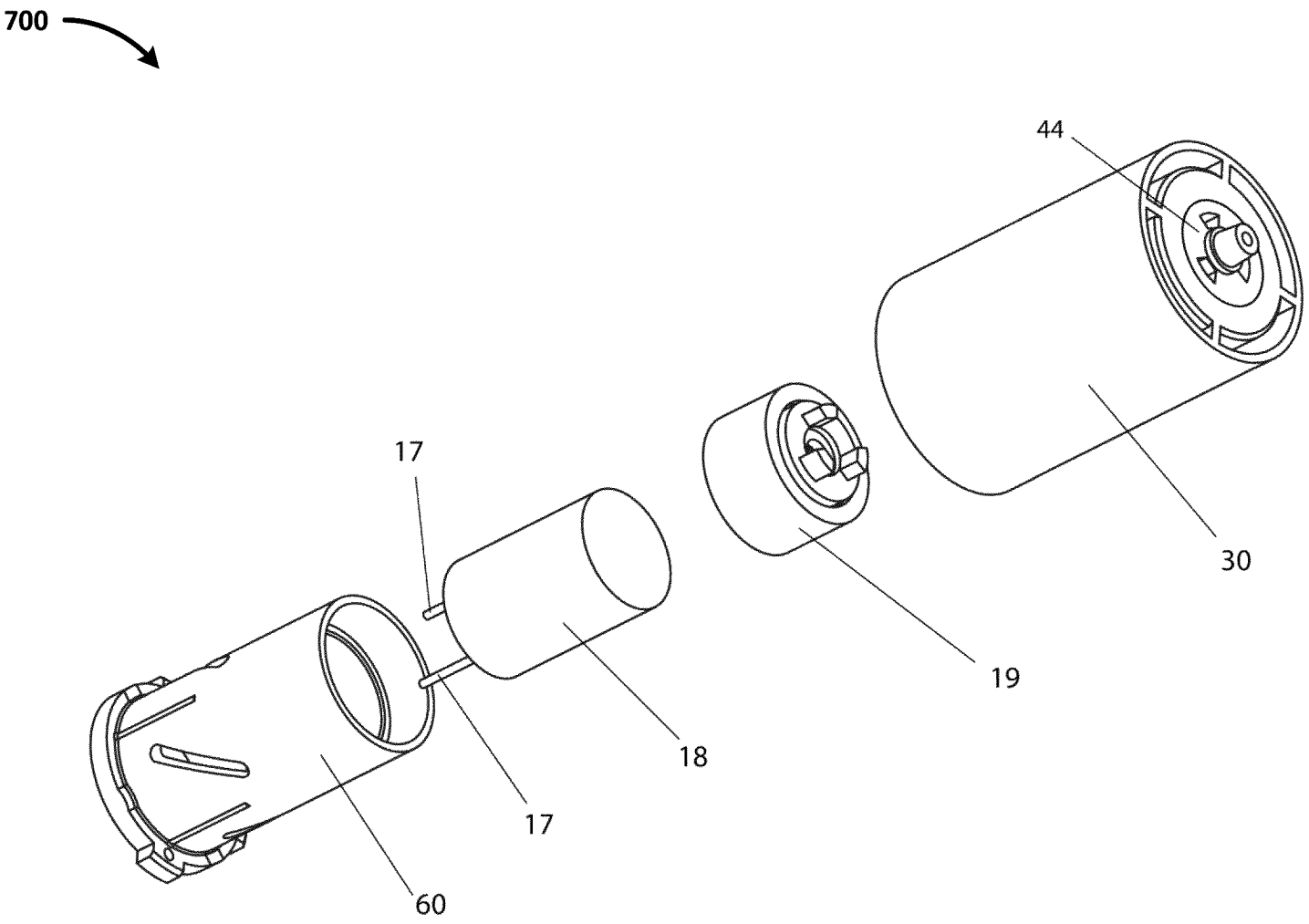
FIG. 7 depicts an exemplary exploded view of the main roller assembly, the view illustrating the roller base, the electric motor, the gear set (assembled), the rotating cap, and the main roller.

FIG. 5 depicts an exemplary view of the exemplary tape dispenser of FIG. 1A, having at least a portion of the main roller removed to illustrate a portion of the gear component(s) and the roller base. FIG. 6 depicts an exemplary exploded view of a portion 600 of the main roller assembly, the view illustrating the roller base, an electric motor disposed in the roller base, a gear set disposed in the roller base, and the rotating cap. FIG. 7 depicts an exemplary exploded view of the main roller assembly 700, the view illustrating the roller base, the electric motor, the gear set (assembled), the rotating cap, and the main roller.

In the depicted example, the gear set 19 includes a planetary gear set. The planetary gear set includes input gear 24*a*, a center gear 25*a*, planet gears 24*b* and 25*b*, and a ring gear 25*c*. FIG. 6 depicts a shaft of the electric motor 18 coupled to the input gear 24*a*. Accordingly, when the electric motor 18 is operated (e.g., energized to begin rotation), the input gear 24*a* induces movement of the gear set 19.

In various implementations, the gear set 19 may include a non-planetary gear(s) and/or gear set(s) to mechanically couple the electric motor 18 to (selectively) operate the main roller 30. In some examples, by way of example and not limitation, the electric motor 18 may be directly coupled to the 30. For example, an output (e.g., output shaft) of the electric motor 18 may be coupled (e.g., directly) to the main roller 30 and/or the roller base 60. In some implementations, by way of example and not limitation, the electric motor 18 may, for example, be mechanically coupled to drive the main roller 30 via a belt(s). Some examples may, for example, be pneumatically and/or hydraulically coupled between the electric motor 18 and the roller base 60 and/or the main roller 30.

In the depicted example, the electric motor 18 is operably coupled to receive power from the battery 14 via a wiring system 5 (e.g., as disclosed at least with reference to FIG. 1B). In some implementations, for example, the electric motor 18 of the tape dispenser 100 may be configured to be activated when the push button 16 is operated into an "ON" state (e.g., depressed). For example, the push button 16 may be operated to form a complete circuit between the battery 14 and the electric motor 18.

As depicted, the position of electric motor and gear component may be configured, for example, to adjust (e.g., increase) an overall weight of the main roller 30 of the tape dispenser 100, and as a result, shifts the center of gravity of tape dispenser 100 towards the main roller 30. In some implementations the weight of the main roller 30 may, by way of example and not limitation, advantageously turn the tape dispenser 100 into an effective front-heavy 'compressing machine' during the taping process. The add-on weight of main roller 30 may, for example, not only effectively distribute the pressure asserted on tape evenly during the taping process, but may, for example, advantageously increase friction for the main roller 30 to move on the surface of target object. The movement of the main roller 30 may, for example, advantageously simultaneously guide and pull the tape 31 smoothly from the adapter 35. Accordingly, the user may, for example, advantageously guide the tape dispenser with decreased effort (e.g., seemingly 'effortlessly') in a desired direction by holding the handle 10.

During an exemplary taping process, the user places the tape dispenser 100 on a surface of an object (e.g., a carton box). The user may, for example, engage the push button 16 located on the shaft of the handle 10. The push button 16 may, for example, connect to a circuit board, and form a complete circuit when pressed by the user. The push button 16 and/or the circuit board may, by way of example and not limitation, complete a circuit to provide power from the battery 14 via an input 17 (e.g., a power cable such as disclosed at least with reference to FIG. 7). In response, the electric motor 18 may be activated, for example, and rotate. Rotation of the electric motor 18 (e.g., of an output shaft of the electric motor 18) may operate the gears of the gear set 19, thereby inducing the rotating cap 20 to rotate. Rotation of the rotating cap 20 may, for example, drive rotation of the main roller 30, thereby operating the main roller 30 to pull the tape 31 from the adapter 35, while at the same time driving the tape dispenser 100 toward a direction guided by the user.

In various implementations, such as depicted, the push button 16 may be placed in a desired position along the shaft of the handle so that it is at a position where it can be easily activated and deactivated by the finger of the hand of the user gripping the handle.

Figure 8:
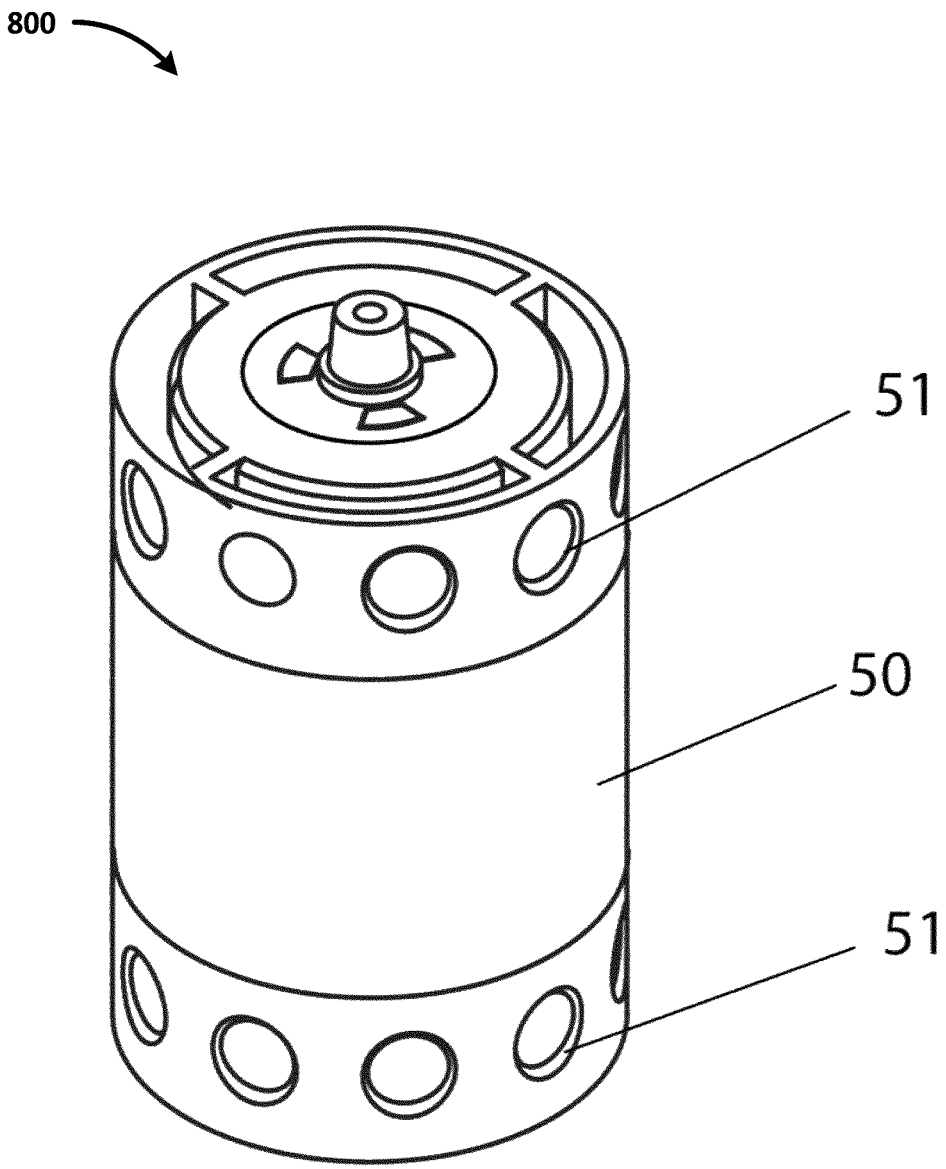
FIG. 8 depicts an illustrative implementation of a main (dispensing) roller.

FIG. 8 depicts an illustrative implementation of a main (dispensing) roller. In some implementations, a main roller may, for example, include multiple sections, such as depicted in FIG. 8. In the depicted example of an exemplary main roller 800, the center section 50 is a smooth section. For example, the center section 50 may be configured for passing (e.g., dispensing) and compressing the tape 31 during operation. The side sections 51 (e.g., left and right, as depicted) are configured to grip when the main roller 800 is driving on the surface of the package.

In various implementations, the main roller 30, the main roller 800, and/or the roller base 60 may be of various designs, materials, sizes, and/or shapes. In some implementations, for example, the main roller (e.g., main roller 30, main roller 800) may be formed in one piece, such as utilizing the same material and/or surface texture as long as it causes a target fastening sheet (e.g., tape 31) to adhere substantially continuously (e.g., smoothly) and provides sufficient traction for the tape dispenser 100 to roll on the surface of a target object.

In the depicted example, the tape dispenser 100 is equipped with a mechanical adapter for the tape 31. As depicted, the adapter 35 is not driven by a motor. In this case, the adapter 35 rotates passively since the work of pulling the tape 31 falls (e.g., solely) on the main roller. In some implementations, the powered, driven main roller 30 can be configured, by way of example and not limitation, to drive the adapter 35. For example, during the taping process, a motor of adapter 35 may be energized (e.g., by the battery 14) and cause rotation motion, which in turn, forwards the tape 31 to the main roller 30. Such examples may, for example, reduce a force required to be applied by the main roller 30 to dispense the tape 31. In some implementations, by way of example and not limitation, a control circuit may control a speed of the adapter 35 relative to a speed of the main roller 30 (e.g., to prevent wadding of the tape and/or maintain a predetermined (minimum) force of the tape 31 on the main roller 30). In some implementations, by way of example and not limitation, the adapter 35 may be of various designs, materials, sizes, and/or shapes. For example, in some implementations, the adapter 35 may be configured in various forms and/or designs including, but not limited to, rod, roller, and/or spring mandrel.

In some implementations, the hand-held tape dispenser 100 may be configured to dispense sheet goods of various types. For example, as described, the sheet goods may be fastening sheet goods. For example, the sheet goods may include tape (e.g., the tape 31). In some implementations, the tape 31 may, for example, be in the form of various materials including, by way of example and not limitation, films, shrink wrap, vinyl, polyvinyl chloride (PVC), paper, rubber, and/or silicone. Various implementation may, for example, be adapted to the particular needs of a particular sheet good and/or material. For example, a speed and/or force of dispensing may be adjusted (e.g., based on a tensile strength and/or elasticity of the material). In some implementations, a diameter of the main roller 30 and/or distance between the main roller 30 and the adapter 35 may be configured based on material properties of the sheet good being dispensed (e.g., thickness, diameter of target roll to be dispensed). In some implementations, the tape may include non-adhesive sheet goods (e.g., shrink wrap, fabric).

In some implementations, when a desired length of tape is dispensed, the tape 31 can be cut off by a cutting mechanism. In various implementation, the cutting mechanism may be of various designs, materials, sizes, and/or shapes. The cutting mechanism may, for example, be implemented to operate in different ways in some implementations, while still fitting the tape dispenser to perform the cutting operation.

In an illustrative method, the user may place the tape 31 under the cutter, and push the handle of the tape dispenser toward the taping surface to allow the cutter to cut off the tape manually.

Figure 9:
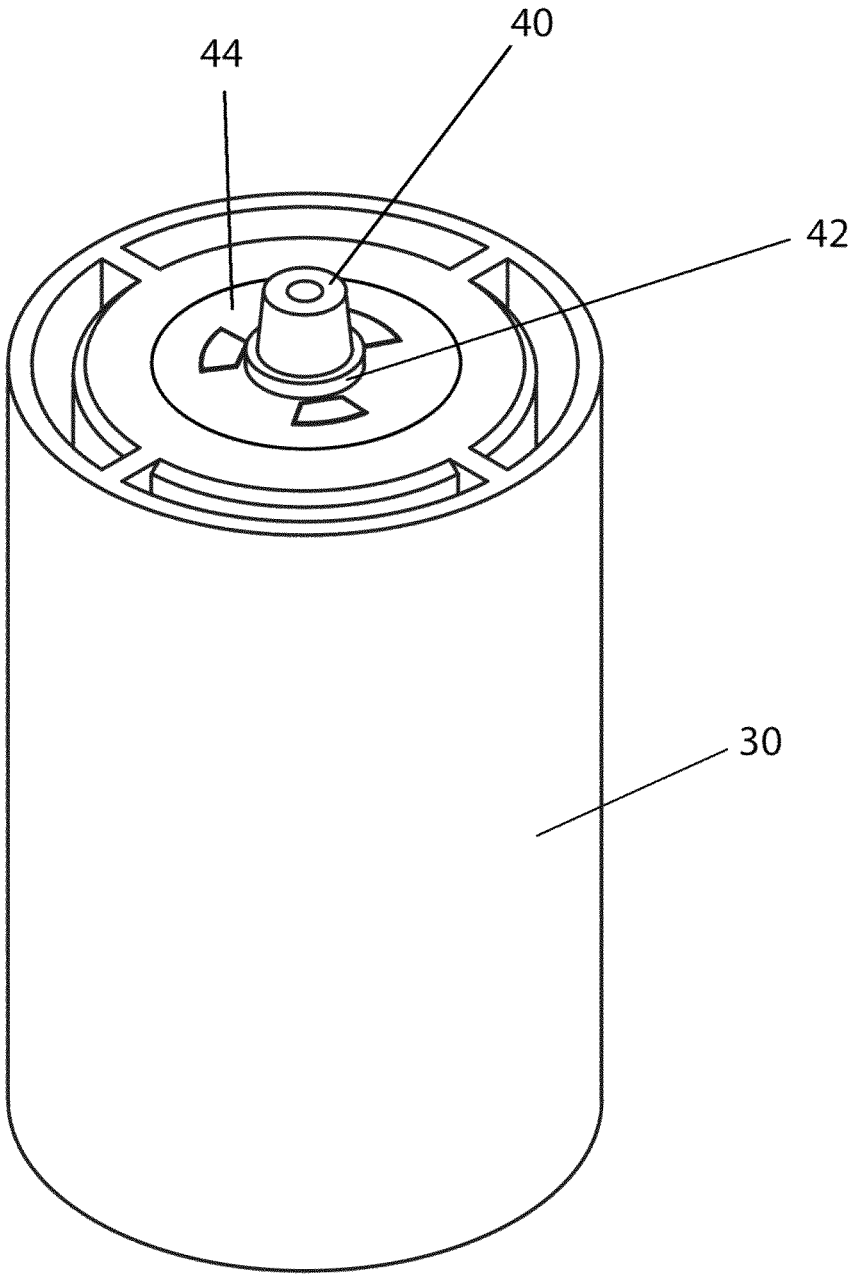
FIG. 9 depicts an illustrative implementation of the main roller of FIG. 1A, illustrating a one-way bearing, an output shaft, and a wheel hub.
Figure 10:
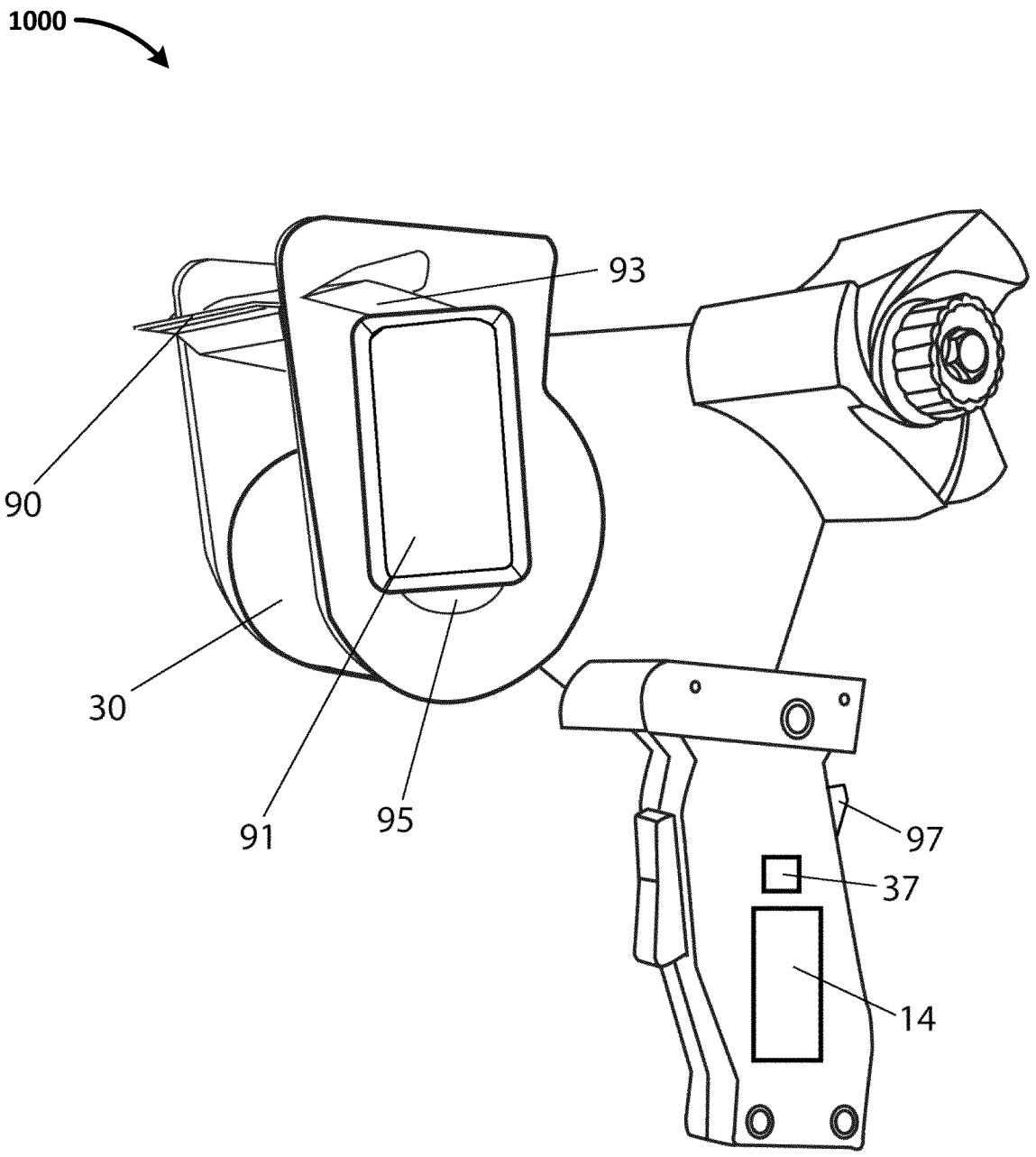
FIG. 10 depicts an exemplary power-dispensing tape dispenser with a cutter, with an at least partially opened handle, and illustrating a battery, a circuit, a shear driver and a cutter.
Figure 11:
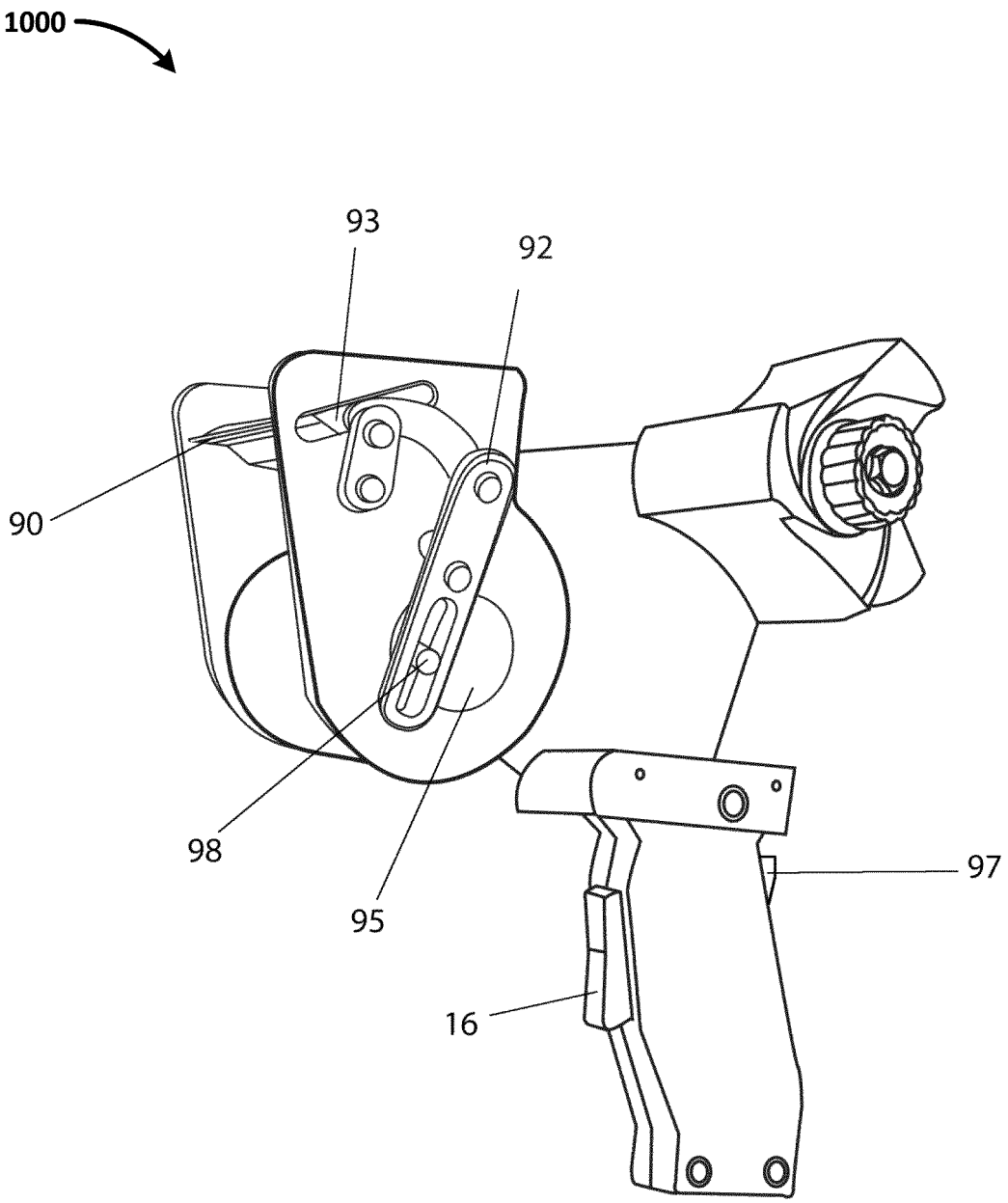
FIG. 11 depicts the exemplary tape dispenser of FIG. 10, illustrating a cutting mechanism center hub, mechanical linkages and the cutter in a retracted position (e.g., stowage mode).
Figure 12:
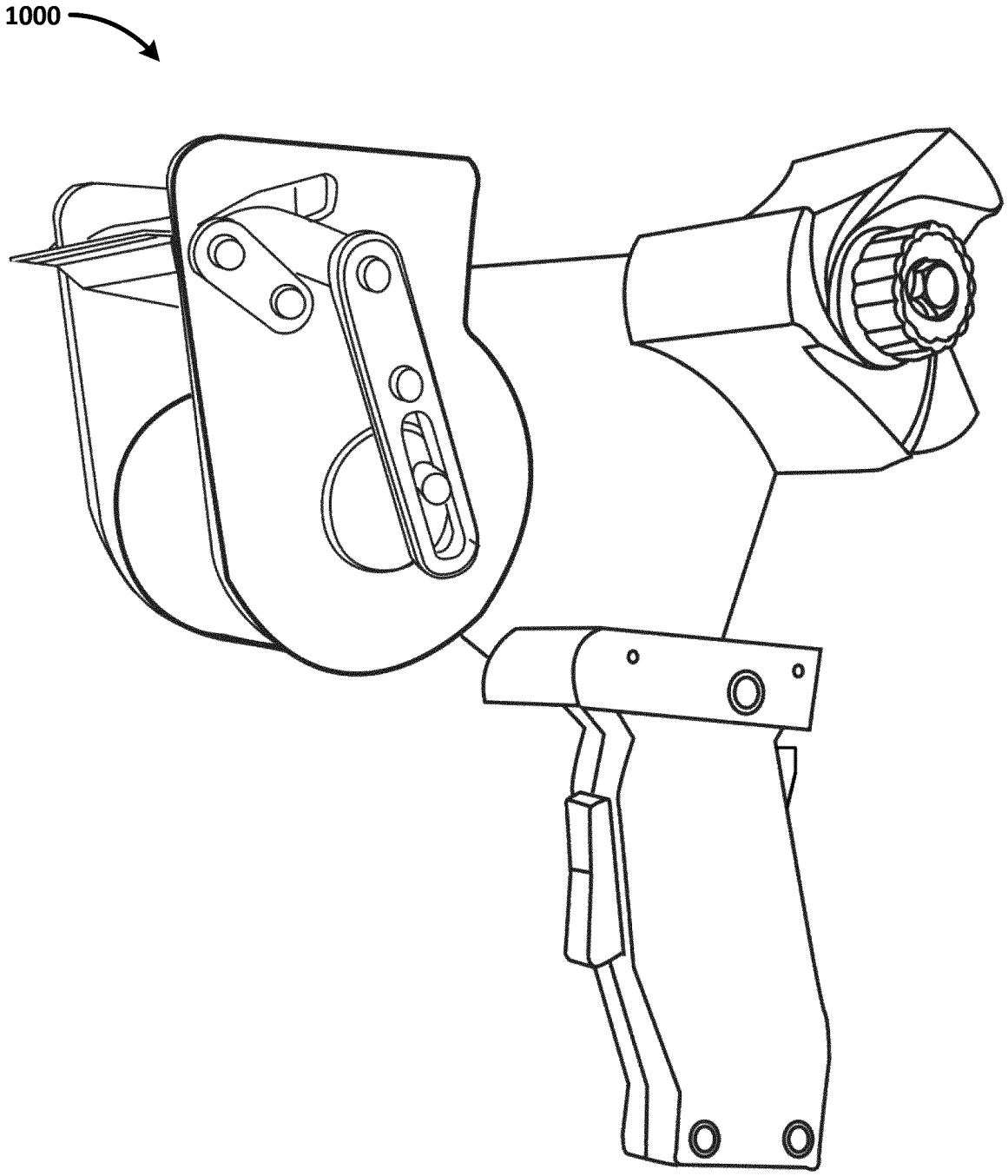
FIG. 12 depicts the exemplary tape dispenser of FIG. 10, illustrating the cutting mechanism center hub, mechanical linkages and cutter in an extended position (e.g., cutting mode).
Figure 13:
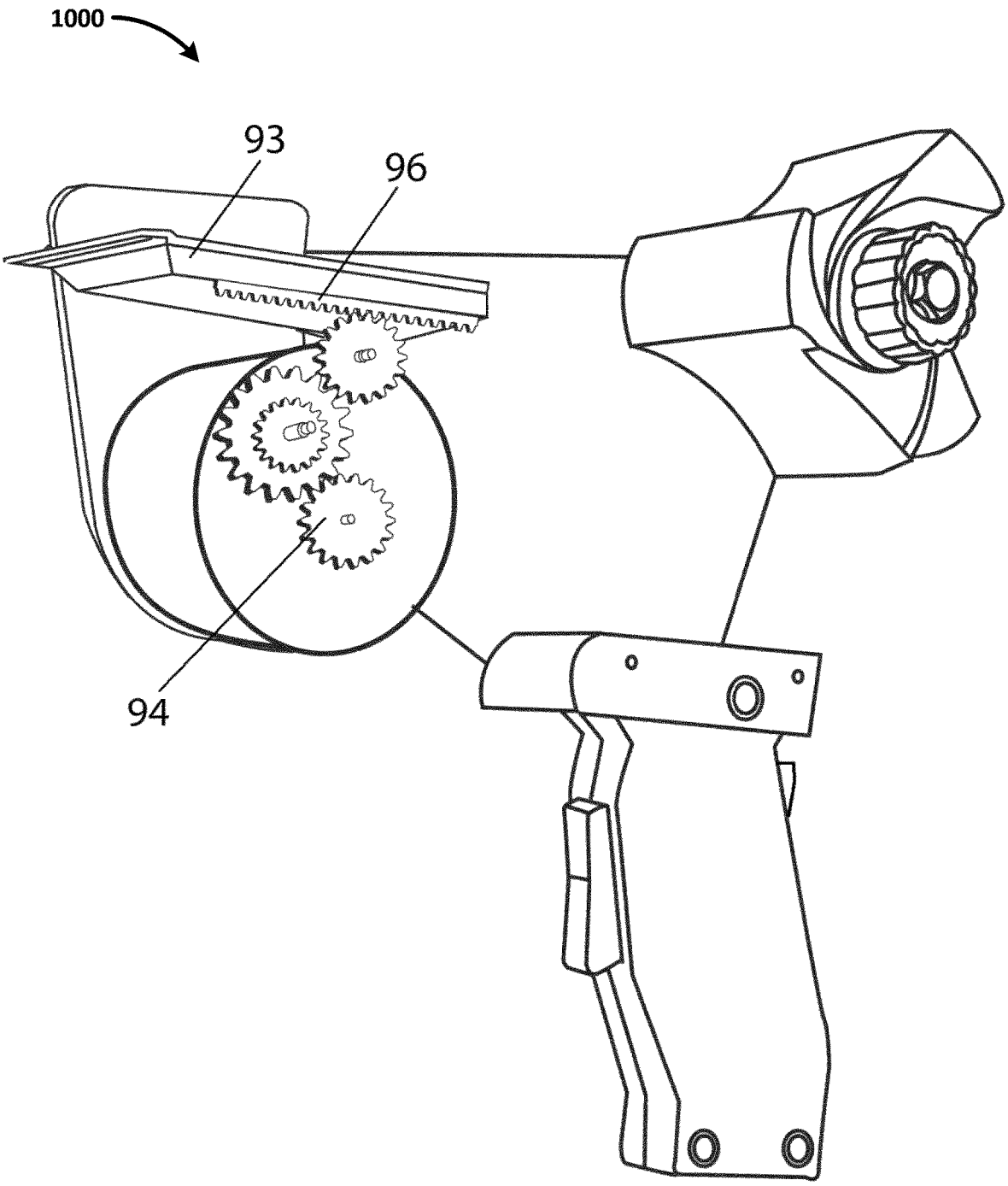
FIG. 13 depicts the exemplary tape dispenser of FIG. 10, illustrating housing and other components removed and illustrating a gear train, gear rack and cutter of a shear driver to selectively operate the cutter.

FIG. 9 depicts an illustrative implementation of the main roller of FIG. 1A, illustrating a one-way bearing, an output shaft, and a wheel hub. FIG. 10 depicts an exemplary power-dispensing tape dispenser with a cutter, with an at least partially opened handle, and illustrating a battery, a circuit, a shear driver and a cutter. FIG. 11 depicts the exemplary tape dispenser of FIG. 10, illustrating a cutting mechanism center hub, mechanical linkages and the cutter in a retracted position (e.g., stowage mode). FIG. 12 depicts the exemplary tape dispenser of FIG. 10, illustrating the cutting mechanism center hub, mechanical linkages and cutter in an extended position (e.g., cutting mode). FIG. 13 depicts the exemplary tape dispenser of FIG. 10, illustrating housing and other components removed and illustrating a gear train, gear rack and cutter of a shear driver to selectively operate the cutter.

In some implementations, by way of example and not limitation, a hand-held tape dispenser 1000 is provided with a powered cutter 93 (e.g., as disclosed at least with reference to FIG. 10). The hand-held tape dispenser 1000 may, for example, be configured as disclosed at least with reference to the hand-held tape dispenser 100, and provided with at least the cutter 93. The powered cutting mechanism may, for example, be actuated by a trigger 97 located on the shaft of the handle. Once triggered, the cutting mode and/or cutting process may be activated. In some implementations, for example, the cutting mode may be managed by a cutter circuit controller 37 of the tape dispenser 1000.

During the taping process, the upper tab(s) 62 (e.g., as disclosed at least with reference to FIG. 4) engage with the wheel hub 44 (e.g., as disclosed at least with reference to FIG. 3) and rotate the main roller 30 in the forward direction motion (e.g., a clockwise rotational direction) while the output shaft 40 is in free motion. During the cutting process (e.g., when a cutting mode is activated), the electric motor 18 may, for example, be configured to rotate in a reverse direction (e.g., a counterclockwise rotational direction), which causes the main roller 30 to run in reverse direction as well.

The reverse motion of main roller 30 may, for example, induce a one-way bearing 42 (e.g., as disclosed at least with reference to FIG. 9) to engage with the output shaft 40. The one-way bearing 42 may be configured, for example, to transmit torque (moment) between the main roller 30 and the output shaft 40. When the main roller 30 is rolling in the forward direction, the one-way bearing 42 allows the output shaft 40 to stay in free motion. When the main roller 30 is rolling in reverse direction, the one-way bearing 42 engages the output shaft 40 and causes it to rotate, which in turn causes the cutting mechanism center hub 95 (e.g., as disclosed at least with reference to FIG. 10) to rotate as well (e.g., simultaneously).

In some implementations, reverse rotation of the electric motor 18 and/or the main roller 30 may, for example, be limited to a predetermined rotation (e.g., rotational angle, number of revolutions, fraction of one revolution). The predetermined rotation limit may, for example, be configured to prevent sticking of the tape 31 and/or tangling and/or wadding of the tape 31 by the reverse rotation of the tape 31.

In the depicted example, once the cutting mechanism center hub 95 is engaged and rotating, it drives a shear driver 91. The shear driver 91 includes mechanical elements configured to engage and drive the cutter 93 to selectively transition (e.g., reciprocate) between an extended position (e.g., cutting mode) and a retracted position (e.g., stowage mode). The action of shear driver 91 causes a cutting edge 90 (e.g., a shaped metal edge, such as a serrated steel blade) mounted to the cutter 93 to (momentarily) enter the path of the packaging tape and cuts off the tape 31. FIG. 11 depicts an illustrative shear driver. The illustrative shear driver includes a series of mechanical linkages 92 including variously interlocking parts.

In the depicted example, the cutting mechanism center hub 95 connects to the mechanical linkages 92 via a connector 98. Mechanical linkages may, for example, transform a given input force and movement into a corresponding (e.g., desired) output force and movement. In this example, the rotation of the cutting mechanism center hub 95 transforms the force and movement to the cutter via the mechanical linkages 92 to perform a cutting operation. FIG. 11 and FIG. 12 further depict the cutter 93 in a retracted position and extended position respectively.

In some implementations, such as disclosed at least with reference to FIG. 13, the shear driver 91 includes a gear train 94 configured to interact with the gear rack 96 positioned at the bottom surface of the cutter 93. In the depicted example, the cutting mechanism center hub is configured as a gear. The motion of the gear on a gear rack 96 induces the cutter 93 to transition (e.g., reciprocate) between the extended and the retracted positions.

The cutting process may, for example, be controlled at least partially according to a timer. For example, a control circuit may operate the cutter 93 into the cutting mode temporarily (e.g., for a predetermined period of time). For example, once the cutting process has completed its timed cycle, the cutter 93 may enter the retracted position and remain unengaged until the cutting operation is actuated by the trigger 97. The cutting process may, for example, be configured to operate for a fixed amount of time as determined by the cutter circuit controller 37.

In some implementations, the cutter 93 may be operated into a cutting position a variable amount of time (e.g., corresponding to a period of time the push button 16 is depressed by the user to activate the cutting mode). In some implementations, for example, the push button 16 may directly activate the cutting mode. In some implementations, for example, release of the push button 16 may directly deactivate the cutting mode.

Figure 14:
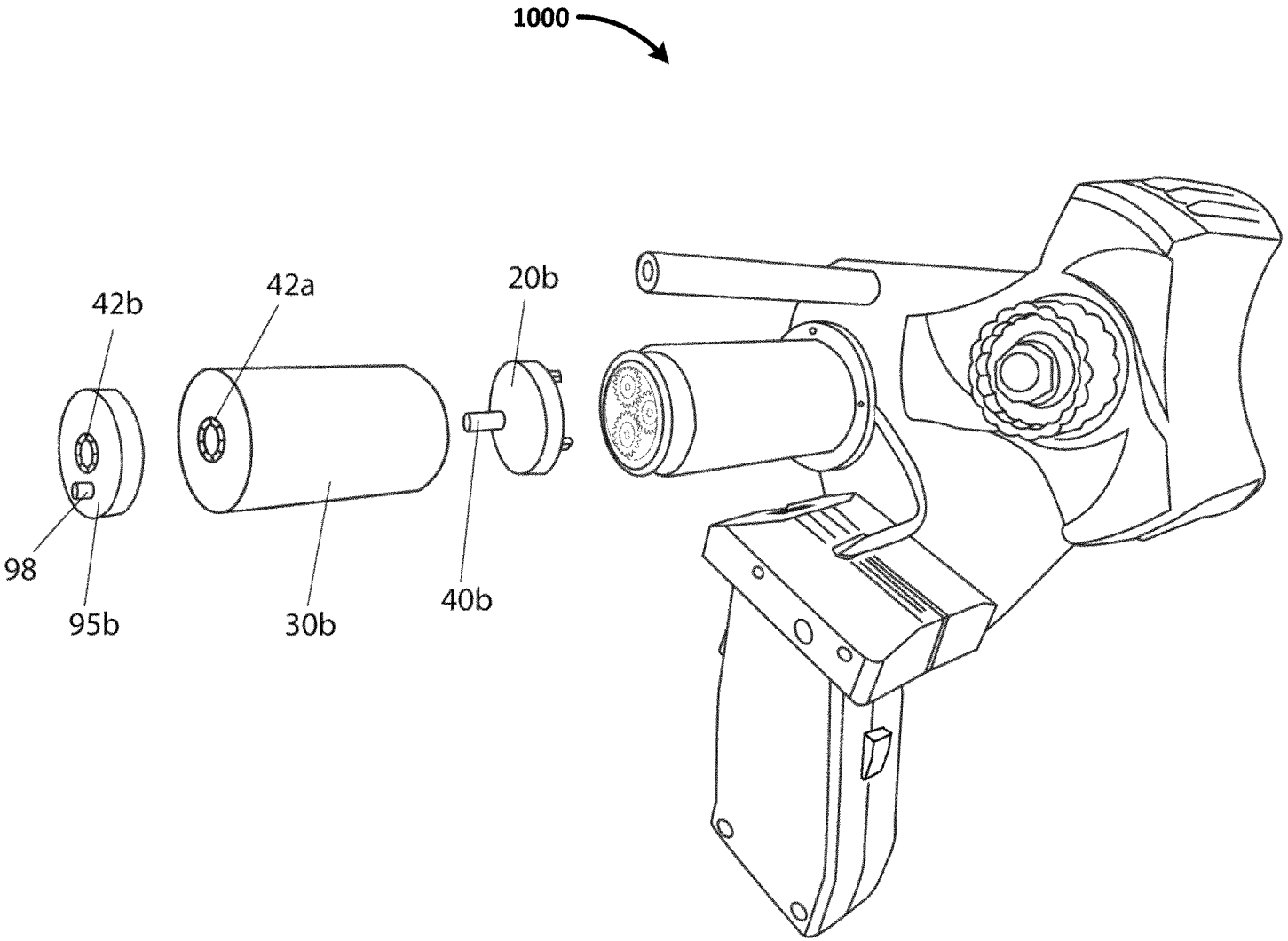
FIG. 14 depicts the exemplary tape dispenser of FIG. 10, illustrating an output shaft on the rotating cap, a first one-way bearing on the main roller, and a second one-way bearing on the cutting mechanism center hub.

FIG. 14 depicts the exemplary tape dispenser of FIG. 10, illustrating an output shaft on the rotating cap, a first one-way bearing on the main roller, and a second one-way bearing on the cutting mechanism center hub. In this depicted implementation, rotation of the main roller (e.g., the main roller 30) may be induced by driving the output shaft (e.g., instead of the engagement the upper tab(s) 62 of the rotating cap 20 with the wheel hub 44 of the main roller).

As depicted in FIG. 14, the output shaft 40*b* is positioned on the surface of a rotating cap 20*b*. The one-way bearing 42*a* is mounted inside the hole of a main roller 30*b*.

During a taping process, the electric motor 18 may be operated running in forward direction, which rotates the output shaft 40*b*. The output shaft 40*b* engages with the one-way bearing 42*a* and rotates the main roller 30*b* in a forward direction (e.g., a clockwise rotational direction).

A second one-way bearing 42*b*, which operates in an opposite rotational direction of the one-way bearing 42*a*, is mounted inside the hole of the cutting mechanism center hub 95*b*. The output shaft 40*b* is inserted through the hole of the main roller 30*b* and further connects with the cutting mechanism center hub 95*b*.

During the taping process, since the one-way bearing 42*b* works in an opposite order (rotational direction) of the one-way bearing 42*a*, the cutting mechanism center hub 95*b* will be in free motion during forward motion of the main hub, disengaging the shear driver 91.

During the cutting process, the electric motor 18 operates in a reverse direction (counterclockwise), which causes the rotating cap 20*b* and the output shaft 40*b* to rotate in the reverse direction. At the same time, the output shaft 40*b* disengages with the one-way bearing 42*a*, thereby causing the main roller 30*b* to move in free motion. The output shaft 40*b* engages with the one-way bearing 42*b* to rotate the cutting mechanism center hub 95*b*. Once the cutting mechanism center hub 95*b* is engaged and rotating, it drives the shear driver 91 via the connector 98. The shear driver 91 will then drive the cutter 93 to reciprocate between the extended and retracted positions.

In some implementations, by way of example and not limitation, the shear driver 91 can be assembled and connected in various ways as long as it causes the cutter 93 (e.g., as disclosed at least with reference to FIG. 11) to reciprocate between the extended and the retracted positions. The cutting edge (e.g., the shaped metal edge), the trigger, the output shaft, the shear mechanism center hub, and/or the mechanical linkages may, for example, be of various designs, materials, sizes, and/or shapes.

In some implementations, the adapter may, for example, be replaced by attaching the tape 31 to the main roller. In this case the adapter 35 may, for example, be omitted. During the taping process, the user engages a push button located on the shaft of the handle. This action may, for example, form a complete circuit (e.g., to operate the motor). Powered by the battery, the electric motor may, for example, activate and rotate the gear set disposed (e.g., encased) within main roller. Rotation of the gear set may, for example, cause the rotating cap to move in a circular motion. Rotation of the rotating cap may drive the main roller, for example, to dispense and release the tape on the surface of the object.

Figure 15:
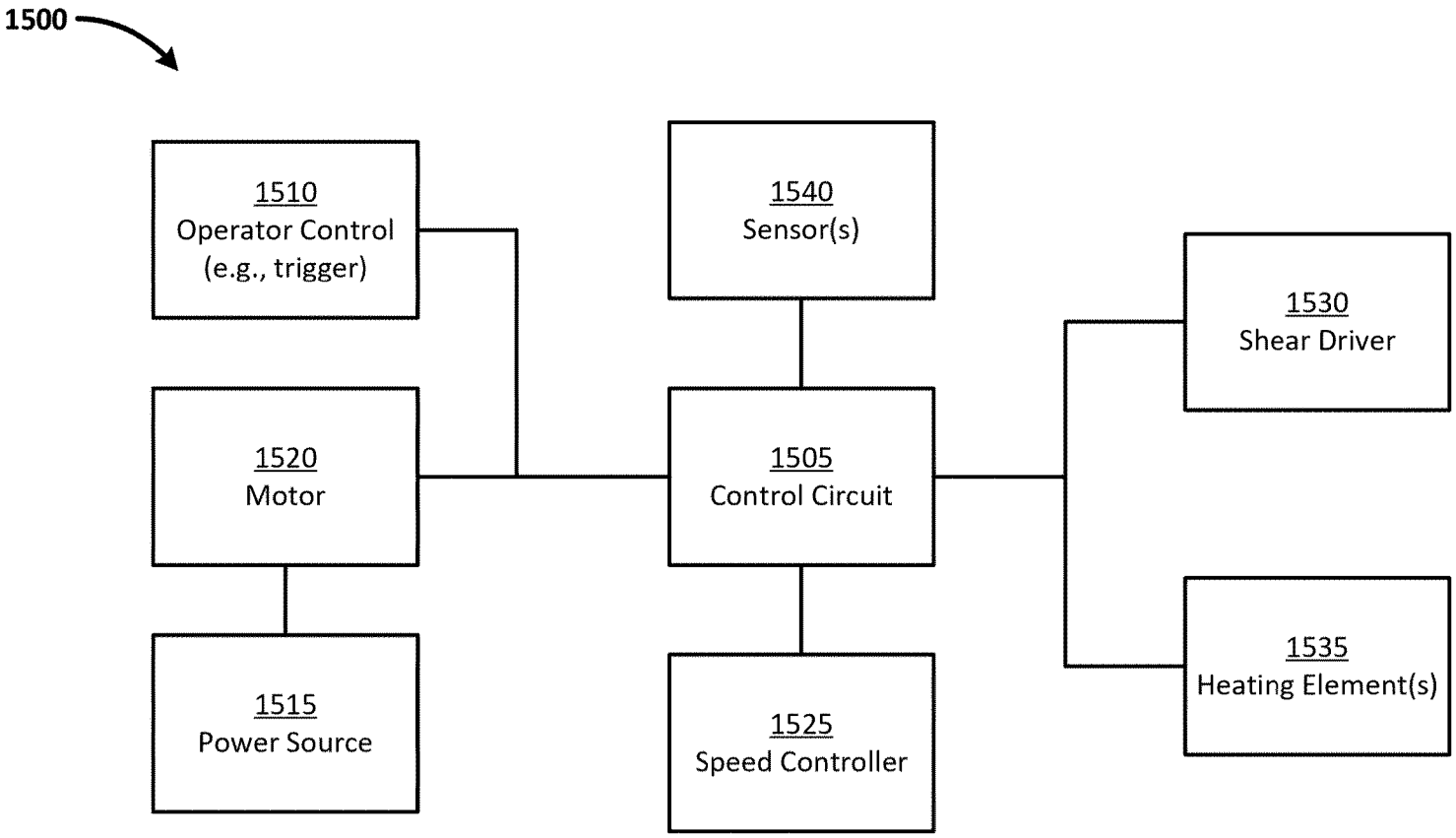
FIG. 15 depicts an exemplary block diagram of an illustrative tape dispenser implementation.

FIG. 15 depicts an exemplary block diagram of an illustrative tape dispenser implementation. The tape dispenser 1500 may, for example, include a control circuit 1505. In the depicted example, the control circuit 1505 is coupled to an operator control 1510 (e.g., an actuator, such as a trigger, a switch, a push button such as the push button 16). The operator control 1510 may, for example, be configured to generate a signal to the control circuit (e.g., by closing a circuit to a voltage source and/or sink such as ground). The operator control 1510 may, for example, cause the control circuit to connect a power source 1515 to a motor 1520.

In the depicted example, the motor 1520 is electrically coupled to the control circuit 1505. The power source 1515 is coupled (e.g., selectively) to the motor 1520. In some implementations, for example, the motor 1520 may be the motor 18.

In some implementations (not shown), by way of example and not limitation, the power source 1515 may be coupled to the control circuit 1505. The control circuit 1505 may, for example, selectively connect the power source 1515 to the motor 1520. For example, the power source 1515 may be the battery 14.

A speed controller 1525 is operably coupled to the control circuit 1505. For example, the speed controller 1525 may be a separate control circuit than the control circuit 1505. In some implementations, for example, the speed controller 1525 may be a module of and/or integrated into the control circuit 1505. The speed controller 1525 may, for example, control a speed of rotation of the motor 1520 (e.g., in response to a signal received from the operator control 1510).

A shear driver 1530 is operably coupled to the control circuit 1505. In some implementations, for example, the shear driver 1530 may be the powered cutter 93. For example, the shear driver 1530 may be powered through the control circuit 1505. In some implementations (not shown), for example, the shear driver 1530 may be coupled to the power source 1515 and activated by the control circuit 1505. In some implementations, the control circuit 1505 may, for example, operate the shear driver 1530 in response to input from the operator control 1510. The control circuit 1505 may, for example, determine whether to operate the shear driver 1530 in response to input from the operator control 1510 based on a current speed of rotation (e.g., of the motor 1520). In some examples, the speed controller 1525 may, by way of example and not limitation, be omitted. In some examples, the shear driver 1530 may, by way of example and not limitation, be omitted.

In the depicted example, a heating element(s) 1535 are operably coupled to the control circuit 1505. For example, the heating element(s) 1535 may be configured to heat a dispensing roller (e.g., the main roller 30, the main roller 800). The control circuit 1505 may, for example, provide the heating element(s) 1535 power from the power source 1515. In some implementations (not shown), by way of example and not limitation, the heating element(s) 1535 may be coupled to the power source 1515 and the control circuit 1505 may selectively operate the heating element(s) 1535. The control circuit 1505 may, for example, operate the heating element(s) 1535 in response to input from a user (e.g., heater on, heater off, auxiliary heat mode on/off) and/or from a sensor(s) (e.g., a temperature sensor). In some examples, the heating element(s) 1535 may, by way of example and not limitation, be omitted.

In the depicted example, one or more sensor(s) 1540 are operably coupled to the control circuit 1505. For example, a speed sensor may determine a speed of rotation of the motor 1520 and/or roller. A location sensor may, for example, determine a position (e.g., linear, angular) of the roller and/or the motor 1520. In some implementations, for example, a temperature sensor may determine a temperature of a dispensed sheet good (e.g., the tape 31), a target object, and/or a roller (e.g., the main roller 30, the main roller 800). In some implementations, a sensor(s) may, by way of example and not limitation, detect operator presence (e.g., proximity sensor and/or switch in the handle) and/or taping process (e.g., force sensor, pressure sensor, displacement sensor detecting engagement of a dispensing roller with a target object). In various implementations, the control circuit 1505 may, for example, operate the motor, the shear driver, the speed controller, and/or the heating element(s) as a function of signal(s) from one or more of the sensor(s) 1540. In some examples, the one or more sensor(s) 1540 may, by way of example and not limitation, be omitted.

Figure 16:
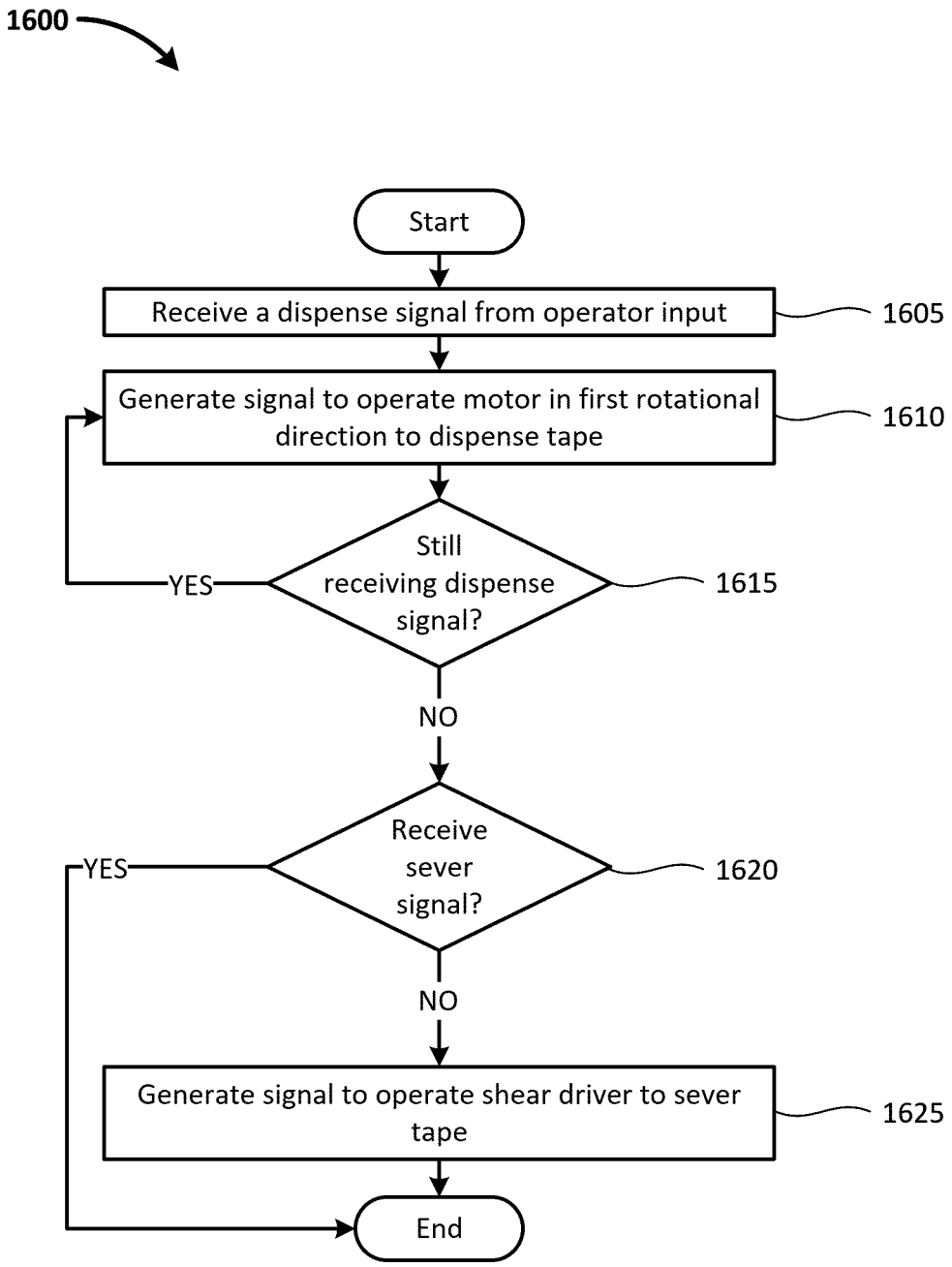
FIG. 16 depicts an exemplary flowchart depicting an illustrative method of controlling operation of a tape dispenser with powered dispensing roller.

FIG. 16 depicts an exemplary flowchart depicting an illustrative method of controlling operation of a tape dispenser with powered dispensing roller. In an illustrative method 1600, a dispense signal is received (e.g., by a control circuit such as the control circuit 1505), in a step 1605, from an operator input (e.g., operator control 1510). A signal to operate a motor (e.g., the motor 1520, the motor 18) in a first rotational direction is generated (e.g., by a control circuit such as the control circuit 1505), in a step 1610, to dispense tape. In a decision point 1615, if it is determined that the dispense signal is still being received, then the signal is continued to be generated in a step 1610. Otherwise, the method 1600 progresses to a decision point 1620.

In the decision point 1620, if it is determined that a sever signal is received (e.g., from an operator input, from an automatic sensor such as travel speed sensor, force sensor), then a signal is generated, in a step 1625, to operate a shear driver (e.g., the shear driver 1530) to enter a cutting mode to sever the tape. Otherwise, the method 1600 ends.

Although various implementations have been described with reference to the figures, other implementations are possible. For example, various implementations may be configured to be supported at least partially be a human hand. Some implementations may, by way of example and not limitation, be configured to be supported (e.g., carried, operated) entirely by a human hand (e.g., in conjunction with a target object(s)). Various such implementations may, for example, be configured with a housing configured to be engaged (e.g., pinched, gripped, held) by a human hand. For example, some examples may include a handle. In some examples, a housing may be sized and/or shaped to be gripped by a human hand.

In some examples, a first roller body and/or a second roller body may be movably coupled to a housing (e.g., a frame member). For example, a first roller body may be coupled to the housing by a spring. As an illustrative example, a first roller body (e.g., with a motor) may be coupled to the housing by a 'mouse-trap' (e.g., a spring-loaded bar) such that the first roller body is urged downwards towards a dispensing position (e.g., from a retracted loading position). The first roller body may, for example, be urged towards one or more dispensing members (e.g., secondary rollers, supporting bars).

In some implementations, a first roller body and/or a second roller body may be of varying size. For example, an outer roller and/or a core may be replaceable (e.g., with different sizes). In some examples, a roller body may include spokes (e.g., configured to engage a roll of sheet goods). The spokes may, by way of example and not limitation, be of varying diameter and/or orientation (e.g., folding, telescoping, flexible such as variable radius of curvature).

Although an exemplary system has been described with reference to the figures, other implementations may be deployed in other industrial, scientific, medical, commercial, and/or residential applications.

In various implementations, some bypass circuits implementations may be controlled in response to signals from analog or digital components, which may be discrete, integrated, or a combination of each. Some implementations may include programmed, programmable devices, or some combination thereof (e.g., PLAs, PLDs, ASICs, microcontroller, microprocessor), and may include one or more data stores (e.g., cell, register, block, page) that provide single or multi-level digital data storage capability, and which may be volatile, non-volatile, or some combination thereof. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

Although an example of a system, which may be portable, has been described with reference to the above figures, other implementations may be deployed in other processing applications, such as desktop and networked environments.

Temporary auxiliary energy inputs may be received, for example, from chargeable or single use batteries, which may enable use in portable or remote applications. Some implementations may operate with other DC voltage sources, such as a 9V (nominal) battery, for example. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Although particular features of an architecture have been described, other features may be incorporated to improve performance. For example, caching (e.g., L1, L2, . . . ) techniques may be used. Random access memory may be included, for example, to provide scratch pad memory and or to load executable code or parameter information stored for use during runtime operations. Other hardware and software may be provided to perform operations, such as network or other communications using one or more protocols, wireless (e.g., infrared) communications, stored operational energy and power supplies (e.g., batteries), switching and/or linear power supply circuits, software maintenance (e.g., self-test, upgrades), and the like. One or more communication interfaces may be provided in support of data storage and related operations.

Some systems may be implemented as a computer system that can be used with various implementations. For example, various implementations may include digital circuitry, analog circuitry, computer hardware, firmware, software, or combinations thereof. Apparatus can be implemented in a computer program product tangibly embodied in an information carrier, e.g., in a machine-readable storage device, for execution by a programmable processor; and methods can be performed by a programmable processor executing a program of instructions to perform functions of various implementations by operating on input data and generating an output. Various implementations can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits).

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. Various implementations may be implemented in a computer system that includes a graphical user interface and/or an Internet browser. To provide for interaction with a user, some implementations may be implemented on a computer having a display device, such as a CRT (cathode ray tube) or LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, the computers and networks forming the Internet, or some combination thereof. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, multiplexing techniques based on frequency, time, or code division, or some combination thereof. Some implementations may optionally incorporate features such as error checking and correction (ECC) for data integrity, or security measures, such as encryption (e.g., WEP) and password protection.

In various implementations, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some implementations, the module(s) may involve execution of preprogrammed instructions, software executed by a processor, or some combination thereof. For example, various modules may involve both hardware and software. In an illustrative aspect, a tape dispenser may include a housing having a handle configured to be held by a human hand. The tape dispenser may include a first roller body rotatably coupled to the housing and configured to rotate about a first axis. The tape dispenser may include a second roller body rotatably coupled to the housing and configured to rotate about a second axis; the second axis being substantially parallel to the first axis. The tape dispenser may include a power source coupled to the housing. The tape dispenser may include a motor disposed within the first roller body and operably coupled to the power source. The tape dispenser may include a trigger coupled to the handle and configured to selectively activate the motor such that, in response to operation of the trigger by a user, the motor operates in a first rotational direction to induce rotation of the first roller body in a second rotational direction about the first axis such that the first roller body dispenses tape from a roll coupled to the second roller body. The tape dispenser may include a cutter member movably coupled to the housing. The tape dispenser may include a shear driver configured to selectively activate the cutter member, in response to an input from a user, to cut the tape after it is dispensed by the first roller body. The housing may be configured such that the first roller body is forward of the handle and such that a force of gravity applied to a hand of a user when the handle is substantially vertical is forward of the handle.

The shear driver may be operably coupled to the power source and may be selectively activated in response to a predetermined input of the user via the trigger. The trigger may have multiple predetermined positions. The trigger may be configured such that operation of the trigger into a first of the multiple predetermined positions activates the motor to operate in the first rotational directional. The trigger may configured such that operation of the trigger into a second of the multiple predetermined positions activates the shear driver.

The first roller body may be coupled to the motor by at least one gear. The at least one gear may be disposed within the first roller body.

The shear driver may be actuated in response to rotation of the motor in a third rotational direction opposite of the second rotational direction. The shear driver may be actuated by the motor via at least one gear. The shear driver may be operated in response to a force applied by the user to the housing that induces displacement of the shear driver. The shear driver may be coupled to the cutter member via at least one linkage.

The first rotational direction may be the second rotational direction.

In an illustrative aspect, a tape dispenser may include a housing having at least a first portion configured to be held by at least a portion of a human hand. The tape dispenser may include a first roller body rotatably coupled to the housing and configured to rotate about a first axis. The tape dispenser may include a motor disposed at least partially within the first roller body. The tape dispenser may include an actuator coupled to the housing and configured such that, in response to operation of the actuator by a user, the motor induces rotation of the first roller body about the first axis. At least the housing, the first roller body, and the motor may configured such that a center of gravity is forward of the first portion.

Rotation of the first roller body may dispense a sheet of material from a roll coupled to the first roller body. The sheet of material may include an adhesive. The sheet of material may include stretch wrap. At least the first roller body may be configured to dispense the stretch wrap. The stretch wrap may, by way of example and not limitation, include shrink wrap such as used to wrap pallets.

The tape dispenser may include a power source operably coupled to the actuator. The power source may be disposed in a handle of the housing. The power source may be in selective communication with the motor via the actuator.

The tape dispenser may include a cutter member movably coupled to the housing. The tape dispenser may include a shear driver configured to selectively activate the cutter member, in response to an input from a user, to cut a sheet of roll goods after it is dispensed by the first roller body. The shear driver may be operably coupled to a power source. The shear driver may be is selectively activated in response to a predetermined input of the user via the actuator. The shear driver may be operated in response to a force applied by the user to the housing that induces displacement of the shear driver.

The motor may induce rotation of the first roller body via at least one gear. The at least one gear may be disposed within the first roller body.

The first portion may include a handle. The housing may be configured such that the first roller body is disposed forward of the handle and such that a force of gravity applied to a hand of a user when the handle is substantially vertical is forward of the handle.

The tape dispenser may include a control circuit operably coupling the motor, the actuator, and a power source. The control circuit may be disposed at least partially in a handle of the housing.

The tape dispenser may include a speed control circuit operably coupled and configured to operate the motor at a variable speed as a function of an intensity of input applied by an operator to the actuator.

The tape dispenser may include a heating element in thermal communication with the first roller body. The heating element being configured to selectively heat the first roller body.

The tape dispenser may include a second roller body rotatably coupled to the housing and configured to rotate about a second axis. The second axis may be substantially parallel to the first axis. An adapter portion of the second roller body may be interchangeable based on a diameter of sheet good roll desired to be coupled to the second roller body.

The first portion may include a handle configured to be gripped by the human hand. The housing may include a finger grip.

The motor may be completely disposed within the first roller body.

In an illustrative aspect, a tape dispenser may include a housing having at least a first portion configured to be held by at least a portion of a human hand The tape dispenser may include a first roller body rotatably coupled to the housing and configured to rotate about a first axis. The tape dispenser may include a motor coupled to the housing. The tape dispenser may include at least one gear disposed at least partially within the first roller body. The at least one gear may be coupled to an output shaft of the motor and coupled to the first roller body. The tape dispenser may include an actuator coupled to the housing and configured such that, in response to operation of the actuator by a user, the motor induces rotation of the first roller body about the first axis via the at least one gear. At least the housing, the first roller body, the at least one gear, and the motor may be configured such that a center of gravity is forward of the first portion.

Rotation of the first roller body may dispense a sheet of material from a roll coupled to the first roller body. The sheet of material may include an adhesive. The sheet of material may include stretch wrap. At least the first roller body may be configured to dispense the stretch wrap.

The tape dispenser may include a power source operably coupled to the actuator. The power source may be disposed in a handle of the housing. The power source may be in selective communication with the motor via the actuator.

The tape dispenser may include a cutter member movably coupled to the housing. The tape dispenser may include shear driver configured to selectively activate the cutter member, in response to an input from a user, to cut a sheet of roll goods after it is dispensed by the first roller body. The shear driver may be operably coupled to a power source. The shear driver may be selectively activated in response to a predetermined input of the user via the actuator. The shear driver may be operated in response to a force applied by the user to the housing that induces displacement of the shear driver.

The motor may be disposed at least partially within the first roller body. The motor may be completely disposed within the first roller body.

The housing may further include a handle. The housing may be configured such that the first roller body is disposed forward of the handle and such that a force of gravity applied to a hand of a user when the handle is substantially vertical is forward of the handle.

The tape dispenser may include a control circuit operably coupling the motor, the actuator, and a power source. The control circuit may be disposed at least partially in a handle of the housing.

The tape dispenser may include a speed control circuit operably coupled and configured to operate the motor at a variable speed as a function of an intensity of input applied by an operator to the actuator.

The tape dispenser may include a heating element in thermal communication with the first roller body. The heating element may be configured to selectively heat the first roller body.

The tape dispenser may include a second roller body rotatably coupled to the housing and configured to rotate about a second axis. The second axis being substantially parallel to the first axis. An adapter portion of the second roller body may be interchangeable based on a diameter of sheet good roll desired to be coupled to the second roller body.

The housing may include handle configured to be gripped by the human hand. The housing may include a finger grip.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A tape dispenser comprising:

a housing (12) having at least a first portion (10) configured to be held by at least a portion of a human hand;

a first roller body (30) rotatably coupled to the housing and configured to rotate about a first axis;

a motor (18) disposed at least partially within the first roller body; and, an actuator (16) coupled to the housing and configured such that, in response to operation of the actuator by a user, the motor induces rotation of the first roller body about the first axis, wherein at least the first roller body and the motor are disposed sufficiently forward of the first portion such that a center of gravity is forward of the first portion, and, wherein the first portion comprises a pistol grip.

2. The tape dispenser of claim 1, wherein rotation of the first roller body dispenses a sheet of material from a roll coupled to the first roller body.

3. The tape dispenser of claim 2, wherein the sheet of material comprises an adhesive.

4. The tape dispenser of claim 2, wherein the sheet of material comprises stretch wrap and at least the first roller body is configured to dispense the stretch wrap.

5. The tape dispenser of claim 1, further comprising a power source operably coupled to the actuator.

6. The tape dispenser of claim 5, wherein the power source is disposed in a handle of the housing.

7. The tape dispenser of claim 5, wherein the power source is in selective communication with the motor via the actuator.

8. The tape dispenser of claim 1, further comprising:

a cutter member movably coupled to the housing; and, a shear driver configured to selectively activate the cutter member, in response to an input from the user, to cut a sheet of roll goods after it is dispensed by the first roller body.

9. The tape dispenser of claim 8, wherein the shear driver is operably coupled to a power source and is selectively activated in response to a predetermined input of the user via the actuator.

10. The tape dispenser of claim 8, wherein the shear driver is operated in response to a force applied by the user to the housing that induces displacement of the shear driver.

11. The tape dispenser of claim 10, wherein the shear driver is coupled to the cutter member via at least one linkage.

12. The tape dispenser of claim 8, wherein:

selective actuation of the actuator induces the motor to operate in a first rotational direction to induce rotation of the first roller body in a second rotational direction about the first axis such that the first roller body dispenses the sheet of roll goods from a roll coupled to a second roller body, and the shear driver is actuated in response to rotation of the motor in a third rotational direction opposite of the second rotational direction.

13. The tape dispenser of claim 12, wherein the shear driver is actuated by the motor via at least one gear.

14. The tape dispenser of claim 1, wherein the motor induces rotation of the first roller body via at least one gear.

15. The tape dispenser of claim 14, wherein the at least one gear is disposed within the first roller body.

16. The tape dispenser of claim 1, wherein the first portion comprises a handle and the housing is configured such that the first roller body is disposed forward of the handle and such that a force of gravity applied to a hand of the user when the handle is substantially vertical is forward of the handle.

17. The tape dispenser of claim 1, further comprising a control circuit operably coupling the motor, the actuator, and a power source.

18. The tape dispenser of claim 17, wherein the control circuit is disposed at least partially in a handle of the housing.

19. The tape dispenser of claim 1, further comprising a speed control circuit operably coupled and configured to operate the motor at a variable speed as a function of an intensity of input applied by an operator to the actuator.

20. The tape dispenser of claim 1, further comprising a heating element in thermal communication with the first roller body, the heating element being configured to selectively heat the first roller body.

21. The tape dispenser of claim 1, further comprising a second roller body rotatably coupled to the housing and configured to rotate about a second axis, the second axis being substantially parallel to the first axis.

22. The tape dispenser of claim 21, wherein an adapter portion of the second roller body is interchangeable based on a diameter of sheet good roll desired to be coupled to the second roller body.

23. The tape dispenser of claim 1, wherein the first portion comprises a handle configured to be gripped by the human hand.

24. The tape dispenser of claim 1, wherein the housing comprises a finger grip.

25. The tape dispenser of claim 1, wherein the motor is completely disposed within the first roller body.

26. The tape dispenser of claim 1, further comprising at least one gear disposed at least partially within the first roller body, wherein the at least one gear is coupled to an output shaft of the motor and coupled to the first roller body.

27. The tape dispenser of claim 1, wherein the actuator comprises a trigger.

* * * * *